US010693237B2

(12) United States Patent
Okoniewski et al.

(10) Patent No.: US 10,693,237 B2
(45) Date of Patent: Jun. 23, 2020

(54) METHOD OF EMPLOYING A SUBSURFACE ANTENNA IN TWO REGIONS

(71) Applicant: Chevron U.S.A. Inc., San Ramon, CA (US)

(72) Inventors: Michal Mieczyslaw Okoniewski, Calgary (CA); Damir Pasalic, Calgary (CA); Gunther Hans Dieckmann, Walnut Creek, CA (US); James Thomas Dunlavey, Bakersfield, CA (US)

(73) Assignee: CHEVRON U.S.A. INC., San Ramon, CA (US)

( * ) Notice: Subject to any disclaimer, the term of this patent is extended or adjusted under 35 U.S.C. 154(b) by 263 days.

(21) Appl. No.: 15/484,751

(22) Filed: Apr. 11, 2017

(65) Prior Publication Data

US 2017/0222297 A1 Aug. 3, 2017

Related U.S. Application Data

(62) Division of application No. 13/838,783, filed on Mar. 15, 2013, now Pat. No. 9,653,812.

(51) Int. Cl.

| | |
|---|---|
| ***H01Q 9/28*** | (2006.01) |
| ***H01Q 9/22*** | (2006.01) |
| ***H01Q 1/04*** | (2006.01) |
| ***H01P 11/00*** | (2006.01) |

(52) U.S. Cl.

CPC ..... *H01Q 9/28* (2013.01); *H01P 11/00* (2013.01); *H01Q 1/04* (2013.01); *H01Q 9/22* (2013.01); *Y10T 29/49016* (2015.01)

(58) Field of Classification Search

CPC . H01P 11/00; H01Q 1/04; H01Q 9/22; H01Q 9/28; Y10T 29/49016

See application file for complete search history.

(56) References Cited

U.S. PATENT DOCUMENTS

| | | | | |
|---|---|---|---|---|
| 4,140,179 | A | 2/1979 | Kasevich et al. | |
| 4,487,257 | A | 12/1984 | Dauphine | |
| 4,508,168 | A | 4/1985 | Heeren | |
| 4,583,589 | A | 4/1986 | Kasevich | |
| 4,646,842 | A | 3/1987 | Arnold et al. | |
| 6,690,170 | B2 | 2/2004 | Homan et al. | |
| 7,209,093 | B2 | 4/2007 | Brune et al. | |
| 7,642,785 | B2 | 1/2010 | Habashy et al. | |
| 8,059,050 | B1 | 11/2011 | Johnson | |
| 8,228,257 | B2 | 7/2012 | Lalezari | |
| 8,443,887 | B2 * | 5/2013 | Parsche | E21B 43/2401 166/302 |
| 9,284,826 | B2 * | 3/2016 | Campbell | E21B 43/2408 |
| 9,458,709 | B2 * | 10/2016 | Sultenfuss | E21B 43/164 |
| 9,598,945 | B2 * | 3/2017 | Okoniewski | H01Q 1/04 |
| 9,653,812 | B2 * | 5/2017 | Okoniewski | H01Q 9/28 |
| 2011/0006055 | A1 | 1/2011 | Diehl | |
| 2012/0018140 | A1 | 1/2012 | Parsche | |

(Continued)

OTHER PUBLICATIONS

Wacker, Bernd, et al.; "Electromagnetic Heating for In-Situ Production of Heavy Oil and Bitumen Reservoirs"; CSUG/SPE 148932, Nov. 2011, pp. 1-14.

*Primary Examiner* — Minh N Trinh

(57) ABSTRACT

A method of making a subsurface antenna which has an assymetric radiation pattern. The assymetric radiation pattern radiates electromagnetic waves unequally into two regions.

10 Claims, 20 Drawing Sheets

(56) References Cited

U.S. PATENT DOCUMENTS

| | | | | |
|---|---|---|---|---|
| 2012/0318498 | A1 | 12/2012 | Parsche | |
| 2014/0266951 | A1 | 9/2014 | Okoniewski et al. | |
| 2015/0192003 | A1* | 7/2015 | Flores | E21B 36/00 166/248 |
| 2017/0222297 | A1* | 8/2017 | Okoniewski | H01Q 9/28 |

* cited by examiner

METHOD OF EMPLOYING A SUBSURFACE ANTENNA IN TWO REGIONS

CROSS-REFERENCE TO RELATED APPLICATIONS

This application is a divisional of, and claims priority to, U.S. Non-Provisional Patent Application bearing Ser. No. 13/838,783, filed on Mar. 15, 2013 now U.S. Pat. No. 9,653,812, which is incorporated by reference in its entirety.

BACKGROUND

Antennas are physical structures that, when energized with electric signals having certain characteristics, generate electromagnetic waves that are emitted into the surrounding medium. Most antennas are designed to operate in free space (the Earth's atmosphere) to transmit the electromagnetic waves through the air. The air is a low loss environment, and radiation patterns having penetration depths of tens, hundreds, or thousands of times the length of the antenna can be achieved. Such antennas are not designed to operate in highly lossy environments, such as under the surface of the Earth.

SUMMARY

In general terms, this disclosure is directed to an antenna designed for use below the surface of the Earth. In some embodiments, and by non-limiting example, the antenna is used for radio frequency heating. Various aspects are described in this disclosure, which include, but are not limited to, the following aspects.

One aspect is a subsurface antenna comprising: a first dipole element extending in a first direction from an input location; and a second dipole element extending in a second direction from the input location, the second direction being opposite the first direction; wherein at least the first dipole element has a first cross-sectional distance that is different from a second cross-sectional distance of the first dipole element.

Another aspect is a method of making a subsurface antenna, the method comprising: determining electrical characteristics of at least a portion of an oil-bearing formation; classifying the portion into at least two regions including a first region and a second region based on the electrical characteristics, wherein the electrical characteristics are different in the first region than in the second region; and constructing an antenna having an asymmetric radiation pattern, wherein the asymmetric radiation pattern radiates electromagnetic waves unequally to compensate for the different electrical characteristics in the first and second regions

DETAILED DESCRIPTION

Figure 1:
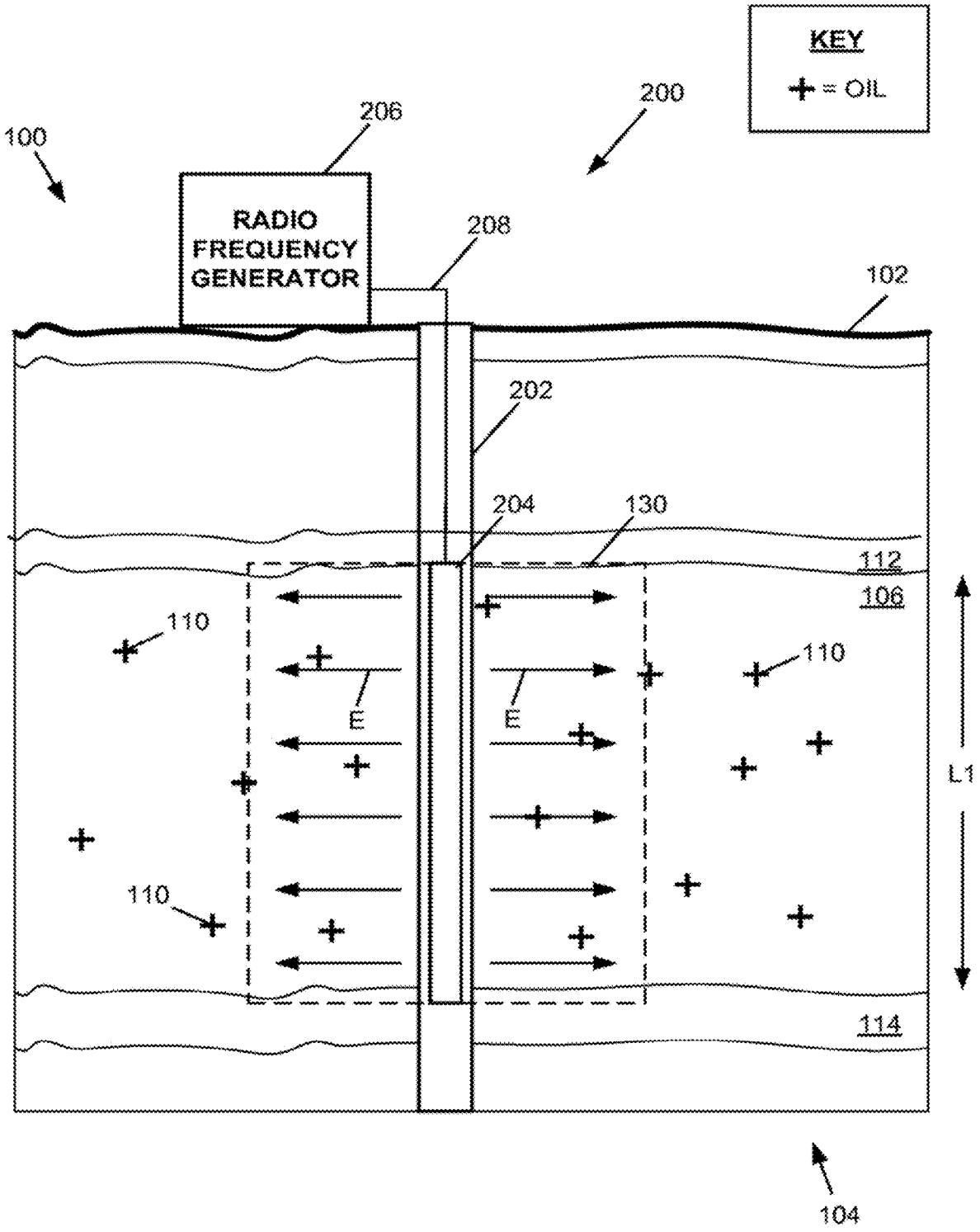
FIG. 1 is a cross-sectional view of a portion of the Earth and further illustrating an oil extraction system heating a first portion of the oil-bearing formation using radio frequency energy.

Various embodiments will be described in detail with reference to the drawings, wherein like reference numerals represent like parts and assemblies throughout the several views. Reference to various embodiments does not limit the scope of the claims attached hereto. Additionally, any examples set forth in this specification are not intended to be limiting and merely set forth some of the many possible embodiments for the appended claims.

As discussed above, most antennas are designed to operate in a low loss environment, such as in the Earth's atmosphere. In contrast, the present disclosure describes an antenna designed to work in a highly lossy environment below the surface of the Earth, such as within an oil reservoir. Such an antenna can be used to heat the oil within the oil reservoir, for example. The typical principles of antenna design that are used in the design of antennas to be operated in free space do not apply to antennas used underground. In other words, an antenna designed to operate in free space will operate very differently when placed in a highly lossy environment. Therefore, there is a need for antennas specifically designed to operate within a highly lossy environment in order for the antenna to operate as desired in this environment.

For example, antennas designed to operate in free space (or, in terrestrial based system in air) are typically designed to achieve a desired far field radiation pattern to accomplish, for example, desired communication goals (radio) or for target detection purposes (radar). The primary design considerations are often directed to obtaining a desirable operational bandwidth, impedance characteristics, as well as directionality of radiated energy (expressed by far field radiation pattern). Penetration depth (the distance over which electric field of a plane wave is reduced to 1/e of its initial value) in air is hundreds, or thousands or millions (and more) of times the wavelength of the propagating wave. In most cases, single frequency broadcast antennas use radiating elements of a constant (non-varying) diameter.

In contrast, in a subsurface antenna the penetration depth of electromagnetic energy in oil bearing formation can be small. The design considerations for subsurface antennas focus primarily on achieving desired near field dissipated energy distribution pattern—encompassing a region that has a distance from the antenna that is typically less than or equal to the length of the antenna for resonant antennas, or less than a few (often less than 1) wavelengths for travelling wave antennas. In such subsurface antennas, design considerations include the avoidance of uneven heating distribution, which can result in hot spots within the formation near the antenna (which can damage the antenna or antenna casing, for example). It is also desirable in some embodiments to obtain a uniform heating distribution of the electromagnetic radiation at depth, to heat the surrounding region as evenly as possible. Therefore, it should be appreciated that both the physics and the design considerations associated with the design of subsurface antennas are significantly different than the physics and design considerations associated with antennas in free space.

We have discovered that very small variations in the diameter of the radiating elements dipolar subsurface antennas can dramatically alter the energy or heating distribution pattern of a subsurface antenna. Thus if the change in the cross-sectional diameter of the dipole antenna divided by the length of the dipole antenna is varied by as little as $1/5{,}000$ to $1/300$, the energy distribution pattern in the subsurface environment will be substantially altered. In contrast, such small variations in the diameter of the conductive element in an above ground dipole antenna have no effect at all on the far field radiation pattern.

FIG. 1 is a schematic cross-sectional view of the portion 100 of the Earth and also illustrates at least part of an example oil extraction system 200. In this example, the portion 100 of the Earth includes a surface 102, a plurality of underground layers 104, and an oil-bearing formation 106. The oil-bearing formation 106 includes oil 110. Also in this example, the part of the oil extraction system 200 includes a wellbore 202, an antenna 204, a radio frequency generator 206, and transmission line 208. A first portion 130 of the oil-bearing formation 106 is also shown.

Typically the oil-bearing formation is trapped between layers 104 referred to as overburden 112 and underburden 114. These layers are often formed of a fluid impervious material that has trapped the oil 110 in the oil-bearing formation 106. As one example, the overburden 112 and underburden 114 may be formed of a tight shale material.

In this example, the portion 100 of the earth includes the oil-bearing formation 106, which includes oil 110. In addition to the oil 110, the oil-bearing formation typically also includes additional materials. The materials can include solid, liquid, and gaseous materials. Examples of the solid materials are quartz, feldspar, and clays. Examples of additional liquid materials include water and brine. Examples of gaseous materials include methane, ethane, propane, butane, carbon dioxide, and hydrogen sulfide.

The oil 110 is a liquid substance to be extracted from the portion 100 of the Earth. In some embodiments the oil is extra heavy, heavy, medium, and/or light crude oil. In some embodiments, the oil 110 is or includes heavy oil.

One measure of the heaviness or lightness of a petroleum liquid is American Petroleum Institute (API) gravity. According to this scale, light crude oil is defined as having an API gravity greater than 31.1° API (less than 870 kg/m3), medium oil is defined as having an API gravity between 22.3° API and 31.1° API (870 to 920 kg/m3), heavy crude oil is defined as having an API gravity between 10.0° API and 22.3° API (920 to 1000 kg/m3), and extra heavy oil is defined with API gravity below 10.0° API (greater than 1000 kg/m3).

Because the oil 110 is intermixed with other materials within the oil-bearing formation, and also due to the high viscosity of the oil, it can be difficult to extract the oil from the oil-bearing formation. For example, if a well is drilled into the oil-bearing formation 106, and pumping is attempted, very little oil is likely to be extracted. The viscosity of the oil 110 causes the oil to flow very slowly, resulting in minimal oil extraction.

An enhanced oil recovery technique could also be attempted. For example, an attempt could be made to inject steam into the formation. However, it has been found that some formations are not receptive to steam injection. The ability of a formation to receive steam is sometimes referred to as steam injectivity. When the formation has poor steam injectivity, little to no steam can be pushed into the formation. The steam may have a tendency to channel along the wellbore, for example, rather than penetrating into the formation 106. Alternatively, the steam may also travel along easily fractured strata or regions of high permeability, thus leading to poor steam injectivity. Accordingly, there is a need for another technique for at least initiating the extraction of oil from the oil-bearing formation that does not rely on the initial injection of steam into the formation when the formation has poor steam injectivity.

Accordingly, one solution is to first heat the first portion 130 of the oil-bearing formation using radio frequency heating, as discussed in further detail below, reducing the viscosity of the oil 110, and causing it to flow more rapidly. A pump (not shown in FIG. 1) of the oil extraction system 200 can then be used to extract the oil 110, opening up voids within the first portion 130 and greatly improving the steam injectivity of the first portion 130 of the oil-bearing formation 106. Steam injection can then be performed, for example, to warm and extract oil 110 from additional portions of the oil-bearing formation 106, for example. Additional examples of systems and methods for extracting oil using radio frequency heating are described in U.S. Ser. No. 13/837,120, titled OIL EXTRACTION USING RADIO FREQUENCY HEATING, and filed on even date herewith, the disclosure of which is hereby incorporated by reference in its entirety.

The wellbore 202 is typically formed by drilling through the surface 102 and into the underground layers 104 including at least through the overburden 112, and typically into the oil-bearing formation 106. The wellbore 202 can be a vertical, horizontal, or diagonal wellbore, or combinations of both. In some embodiments, the wellbore includes an outer cement layer surrounding an inner casing. In some embodiments the casing is formed of fiberglass or other RF transparent material. An interior space is provided inside of the casing of the wellbore 202, which permits the passage of parts of the oil extraction system 200 as well as fluids and steam, as discussed herein. In some embodiments, the interior space of the wellbore 202 has a cross-sectional distance in a range from about 5 inches to about 36 inches. Additionally, in some embodiments apertures are formed through the casing and cement to permit the flow of fluid and steam between the oil-bearing formation 106 and the interior space of the wellbore 202.

In this example, radio frequency heating is initiated by inserting an antenna 204 into the wellbore 202. The oil 110 within a first portion 130 of the oil-bearing formation 106 is then heated using radio frequency energy supplied by the radio frequency generator 206.

The antenna 204 is a device that converts electric energy into electromagnetic energy, which is radiated in part from the antenna 204 in the form of electromagnetic waves (E, in FIG. 1) and in part forms a reactive electromagnetic field near the antenna. Examples of antenna 204 are illustrated and described in more detail herein. In some embodiments the antenna has a length L1 approximately equal to a dimension of the oil-bearing formation 106, such as the vertical depth of the formation 106. For a horizontal wellbore 202, the length L1 can be selected to be equal to a horizontal dimension of the oil-bearing formation 106. Longer or shorter lengths can also be used, as desired. In some embodiments, a length L1 of the antenna 204 is in a range from about 30 meters to about 3000 meters. Other embodiments have antennas 204 of other sizes.

The antenna 204 is inserted into the wellbore 202 and lowered into position, such as using a rig (not shown) at the surface 102. Rigs are typically designed to handle pieces having a certain maximum length, such as having a length from 40 feet to 120 feet. Accordingly, in some embodiments the antenna 204 is formed of two or more pieces having lengths equal to or less than the maximum length. In some embodiments ends of the antenna 204 pieces are threaded to permit the pieces to be screwed together for insertion into the wellbore 202. The antenna is then lowered down into the wellbore until it is positioned within the oil-bearing formation 106.

The radio frequency generator 206 operates to generate radio frequency electric signals that are delivered to the antenna 204. The radio frequency generator 206 is typically arranged at the surface in the vicinity of the wellbore 202. In some embodiments, the radio frequency generator 206 includes electronic components, such as a power supply, an electronic oscillator, frequency tuning circuitry, a power amplifier, and an impedance matching circuit. In some embodiments, the generator includes a circuit that measures properties of the generated signal and attached loads, such as for example: power, frequency, as well as the reflection coefficient from the load. In some embodiments, the radio frequency generator 206 is operable to generate electric signals having a frequency inversely proportional to a length L1 of the antenna to generate standing waves within the 304. For example, when the antenna 204 is a half-wave dipole antenna, the frequency is selected such that the wavelength of the electric signal is roughly twice the length L1. In some embodiments the radio frequency generator 206 generates an alternating current (AC) electric signal having a sine wave.

In some embodiments, the frequency or frequencies of the electric signal generated by the radio frequency generator is in a range from about 5 kHz to about 20 MHz, or in a range from about 50 kHz to about 2 MHz. In some embodiments the frequency is fixed at a single frequency. In another possible embodiment, multiple frequencies can be used at the same time.

In some embodiments, the radio frequency generator 206 generates an electric signal having with a power in a range from about 50 kilowatts to about 2 megawatts. In some embodiments, the power is selected to provide minimum amount of power per unit length of the antenna 204. In some embodiments, the minimum amount of power per unit length of antenna 204 is in a range from about 0.5 kW/m to 5 kW/m. Other embodiments generate more or less power.

The transmission line 208 provides an electrical connection between the radio frequency generator 206 and the antenna 204, and delivers the radio frequency signals from the radio frequency generator 206 to the antenna 204. In some embodiments, the transmission line 208 is contained within a conduit that supports the antenna in the appropriate position within the oil-bearing formation 106, and is also used for raising and lowering the antenna 204 into place. An example of a conduit is a pipe. One or more insulating materials are included inside of the conduit to separate the transmission line 208 from the conduit. In some embodiments the conduit and the transmission line 208 form a coaxial cable. In some embodiments the conduit is sufficiently strong to support the weight of the antenna 204, which can weigh as much as 5,000 pounds to 10,000 pounds in some embodiments.

In some embodiments, once the antenna 204 is properly positioned in the oil-bearing formation, the radio frequency generator 206 begins generating radio frequency signals that are delivered to the antenna 204 through the transmission line 208. The radio frequency signals are converted into electromagnetic energy, which is emitted from the antenna 204 in the form of electromagnetic waves E. The electromagnetic waves E pass through the wellbore and into at least a first portion 130 of the oil-bearing formation. The electromagnetic waves E cause dielectric heating to occur, primarily due to the molecular oscillation of polar molecules present in the first portion 130 of the oil-bearing formation 106 caused by the corresponding oscillations of the electric fields of the electromagnetic waves E. The radio frequency heating continues until a desired temperature has been achieved at the outer extents of the first portion 130 of the oil-bearing formation 106, which reduces the viscosity of the oil to enhance flow of fluids within the oil-bearing formation 106. In some embodiments the power of the electromagnetic energy delivered is varied during the heating process (or turned on and off) as needed to achieve a desired heating profile.

Figure 2:
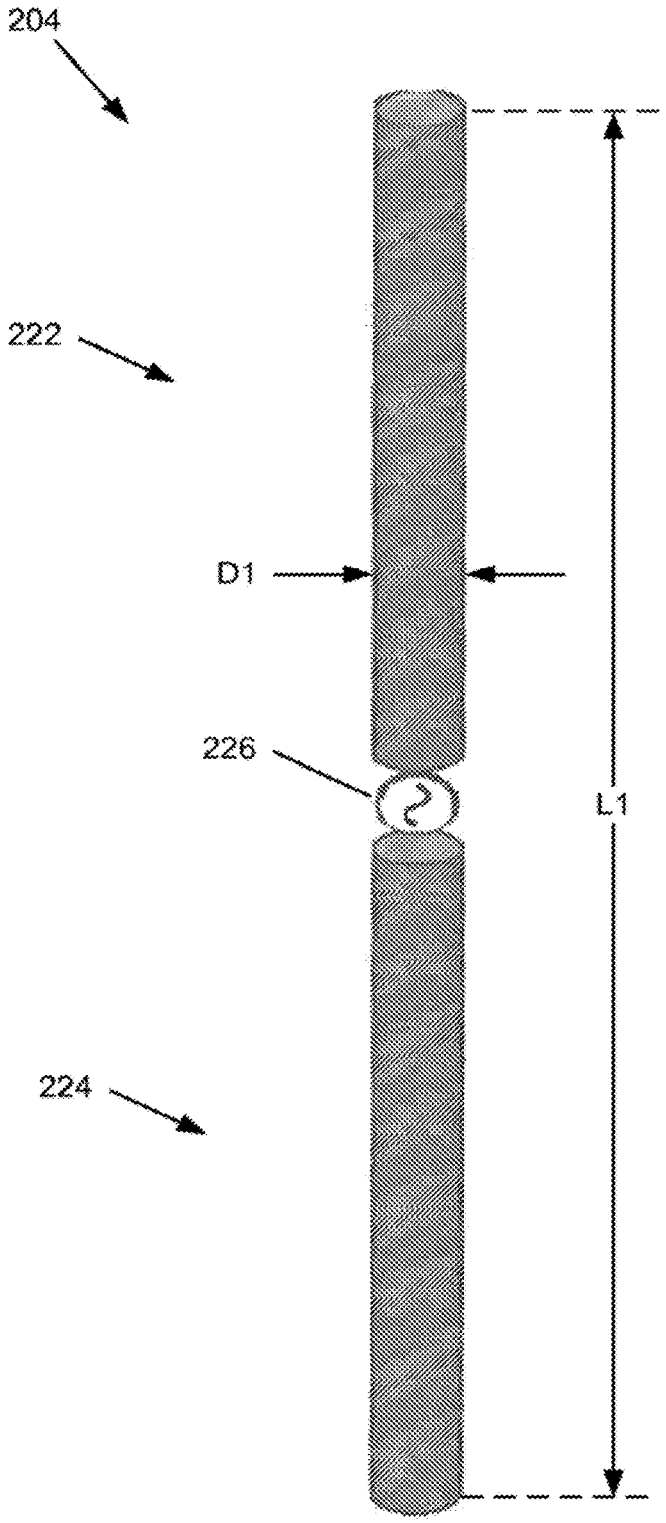
FIG. 2 is a schematic perspective view of an example subsurface antenna, namely a non-shaped dipole antenna.

FIG. 2 is a schematic perspective view of an example antenna 204. In this example, the antenna 204 is a dipole antenna including antenna elements 222 and 224, and input terminal 226. The example shown in FIG. 2 is an example of a dipole antenna, and more specifically of a non-shaped dipole antenna, as described in further detail herein.

The antenna elements 222 and 224 are coupled together at the input terminal 226, and extend in opposite directions from the input terminal 226. In some embodiments, the central axes of the first and second elements 222 and 224 are aligned.

In this example, the antenna elements 222 and 224 have a cylindrical shape, with a circular cross-section. A cross-sectional distance D1 across the first and second elements 222 and 224 (which is equal to the diameters, in this example), are equal and constant along the length L1 of the antenna 204. In some embodiments, the antenna 204 is sized to fit within an interior space of a wellbore 202 (FIG. 1), and as a result has a distance D1 that is selected to fit within this space. Therefore, in some embodiments the distance D1 is less than a distance in a range from about 5 inches to about 36 inches. For example, in some embodiments the distance D1 is in a range from about 1 inch to about 35 inches in diameter, or from about 1 inch to about 8 inches in diameter. Examples of the length L1 are described herein with reference to FIG. 1.

The antenna elements 222 and 224 are formed of electrically conductive material, such as a metal. Examples of suitable materials are aluminum, copper, alloys, or combinations thereof. In some embodiments the antenna elements 222 and 224 are separated by a gap, which can include one or more insulating materials.

Figure 3:
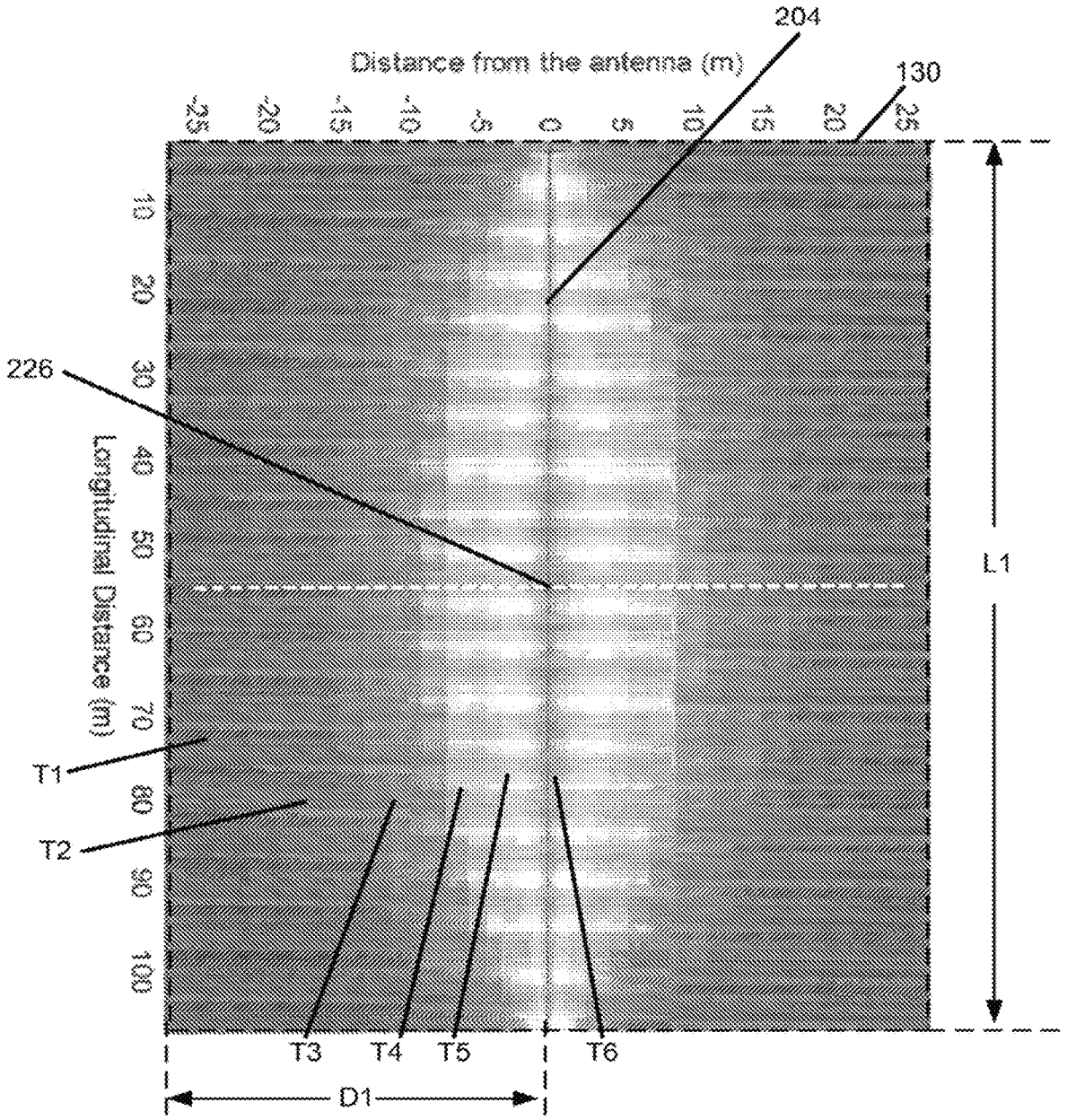
FIG. 3 is a diagram depicting a calculated temperature distribution after heating with the antenna shown in FIG. 2.

FIG. 3 is a diagram depicting the temperature distribution of the first portion 130 of a homogeneous oil-bearing formation 106 after radio frequency heating using the antenna 204 shown in FIG. 2.

The time required to heat the first portion 130 of the oil-bearing formation 106 depends on a number of factors, including the distance across the first portion 130 to be heated, the desired minimum temperature to be achieved within the first portion 130, the power generated by the radio frequency generator, the frequency of the radiation, the length of the antenna, the structure and composition of the wellbore, and the dielectric properties (dielectric constant and loss tangent) of the first portion 130, as well as the properties of the oil formation.

The radio frequency heating operates to raise the temperature of the oil-bearing formation 106 from an initial temperature to at least a desired temperature greater than the initial temperature. In some formations, the initial temperature can range from as low as 40° F. to as high as 240° F. In other formations, the initial temperature is much lower, such as between about 40° F. and about 80° F. Radio frequency heating is performed until the temperature within the first portion 130 is raised to the desired minimum temperature to reduce the viscosity of the oil 110 sufficiently. In some embodiments, the desired minimum temperature is in a range from about 160° F. to about 200° F., or about 180° F. In some embodiments, the temperature of the first portion 130 is increased at least between about 40° F. and about 80° F., or about 60° F. Much higher temperatures can also be achieved in some embodiments, particularly in portions of the oil-bearing formation immediately adjacent to the antenna 204.

In some embodiments, the radial distance D2 between the antenna 204 and the outer periphery of the first portion 220 is in a range from about 10 feet to about 50 feet, or about 30 feet. To demonstrate the three-dimensional size of an example first portion 220, when the first portion 220 has a radial distance D2 of 30 feet and a height of 150 feet, the volume of the first portion 220 is 424,115 cubic feet of oil-bearing formation. Radio frequency heating can be used to heat a first portion 130 having sizes greater than or less than these examples. A larger size can be obtained, for example, by increasing the length of the antenna 204 and providing additional power to the antenna, or by increasing the length of time of the radio frequency heating.

In some embodiments, the length of time that the radio frequency heating is applied is in a range from about 1 month to about 1 year, or in a range from about 4 months to about 8 months, or about 6 months. Other time periods are used in other embodiments. As discussed above, the time period can be adjusted by adjusting other factors, such as the power of the antenna, or the size of the first portion 130.

The diagram in FIG. 3 demonstrates the temperature distribution within different regions of the first portion 130 after heating for a period of time with the antenna 204, shown in FIG. 2. The most distal regions are the coolest (temperature T1), while the proximal regions are the warmest (temperature T6). In some embodiments, the temperature T1 is in a range from about 160° F. to about 200° F., or about 180° F. In some embodiments the temperature T6 reaches about 470° F. The temperatures T2, T3, T4, and T5 are between temperatures T1 and T6.

As illustrated in FIG. 3, a drawback with the dipole antenna 204 shown in FIG. 2 is that the distribution pattern tends to focus the electromagnetic energy in the region of the antenna 204 input terminal 226. In other words, for a given distance away from the antenna 204 (e.g., 10 meters), the temperatures along the longitudinal distances of the antenna 204 are higher at the center, and lower in either direction away from the center. This can limit the temperatures that can be achieved throughout the extent of the first portion 130. If the temperature at the input terminal 226 becomes too high, the antenna 204, casing, or wellbore could be damaged, for example.

In the example shown in FIG. 3, the oil-bearing formation 106 is assumed to be homogeneous with a dielectric constant of 85.3 and a loss tangent of 2.37.

FIGS. 4, 6, 9, 11, 12, and 18 illustrate examples of antennas referred to herein as shaped antennas. In some embodiments, the shaped antennas have at least one antenna element in which at least one cross-sectional distance is different from another cross-sectional distance.

Figure 4:
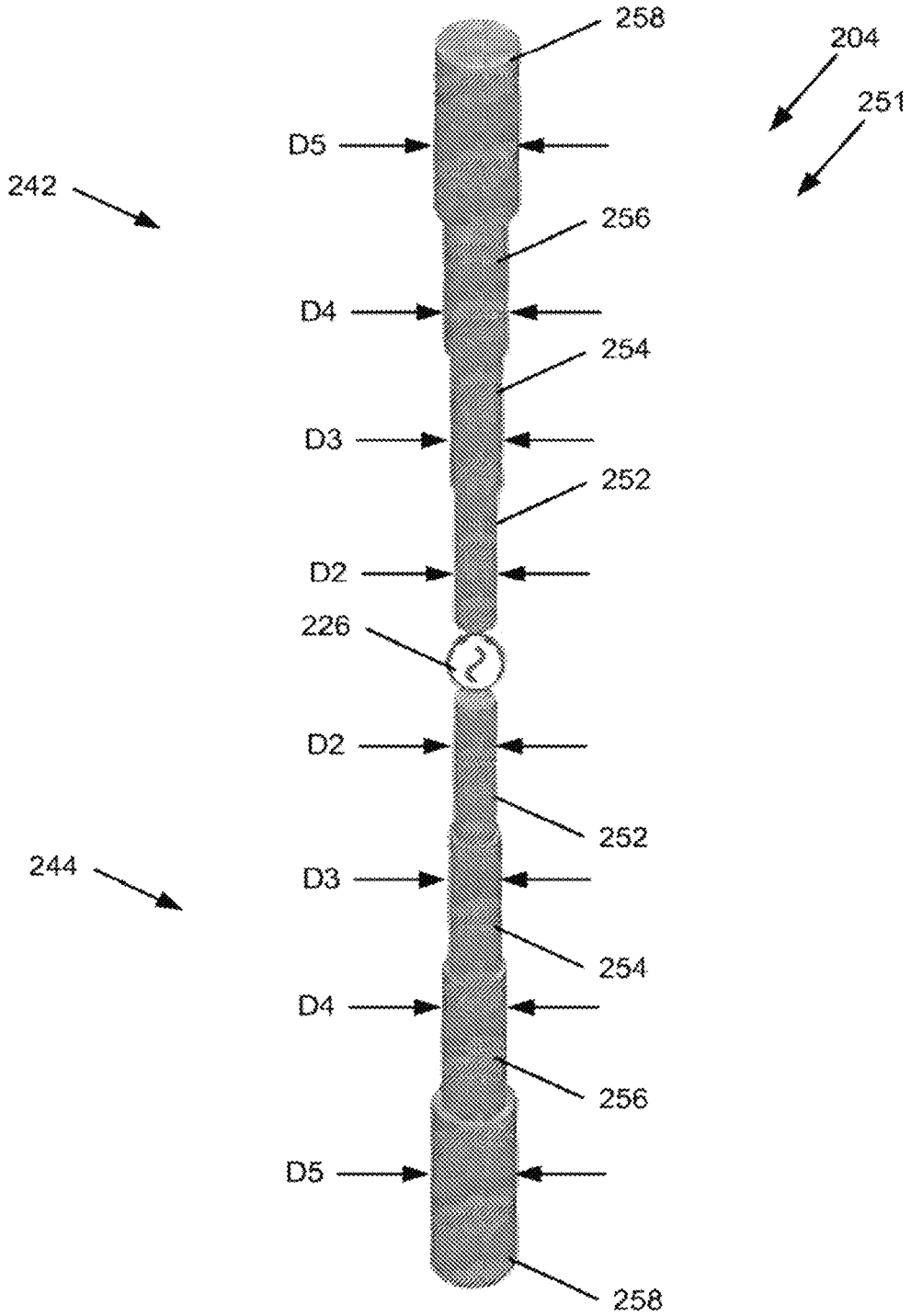
FIG. 4 is a schematic perspective view of another example subsurface antenna, namely a dual stepped shaped antenna.

FIG. 4 is a schematic perspective view illustrating another example of the antenna 204. The example shown in FIG. 4 is an example of a shaped antenna, and more specifically a dual stepped shaped antenna 251. In this example, the antenna 251 is a dipole antenna similar to that shown in FIG. 2, but includes antenna elements 242 and 244 in which the cross-sectional distances (D2 to D5) of the antenna elements 224 and 244 are not constant.

In this example, the antenna elements 242 and 244 each include multiple regions, such as the four regions 252, 254, 256, and 258. Other embodiments include other quantities of the regions, such as two or more regions.

The cross-sectional distances D2, D3, D4, and D5 are not the same. In this example, the region 252 has a cross-sectional distance D2, the region 254 has a cross-sectional distance D3, the region 256 has a cross-sectional distance D4, and the region 256 has a cross-sectional distance D5. Distance D3 is greater than distance D2, D4 is greater than D3, and D5 is greater than D4. Therefore, for example, the cross-sectional distance D5 of the distal region 258 is greater than the cross-sectional distance D2 of the proximal region 252, and all other regions 254 and 256. In some embodiments, the regions 252, 254, 256, and 258 are cylindrical, such that the cross-sectional distances D2, D3, D4, and D5 are the diameters of the regions 252, 254, 256, and 258.

Another example dual stepped shaped antenna 251 has five regions, including regions 252, 254, 256, 258, and a fifth region 260 (not shown in FIG. 4). Diameters of the regions are D2, D3, D4, D5, and D6 (not shown in FIG. 4), respectively.

The following dimensions are provided to illustrate exemplary dimensions of one possible embodiment of the antenna 251, having five regions on each of the antenna elements 242 and 244. Region 252 has a diameter D2 of 4 inches in diameter and a length of 10 meters. Region 254 has a diameter D3 of 5 inches and a length of 10 meters. Region 256 has a diameter D4 of 6 inches and a length of 10 meters. Region 258 has a diameter D5 of 7 inches and a length of 10 meters. Region 260 (not shown in FIG. 4) has a diameter of 8 inches and a length of 10 meters.

To further illustrate an exemplary embodiment, an example antenna 251 operates at 550 kHz. Accordingly, the change in cross-sectional distance (e.g., change in cross-sectional diameter) of the conductive elements 242 and 244 is 4 inches or 0.10 meters. This change in diameter (e.g., 0.1 meters), divided by the length of the antenna (e.g., 100 meters), is only 1/1000. Thus, even a small change in the cross-sectional diameter of the antenna divided by the total length of the dipole antenna of only 1/1000 is large enough to dramatically alter the radiation pattern of the subsurface antenna. In some embodiments, the difference in the cross-sectional distance divided by the length of the antenna is in a range from about 1/5,000 to about 1/300. If this example antenna 251 is placed in service above ground, its far field radiation pattern would not be altered by such a small change cross-sectional distance of the conductive elements.

Figure 5:
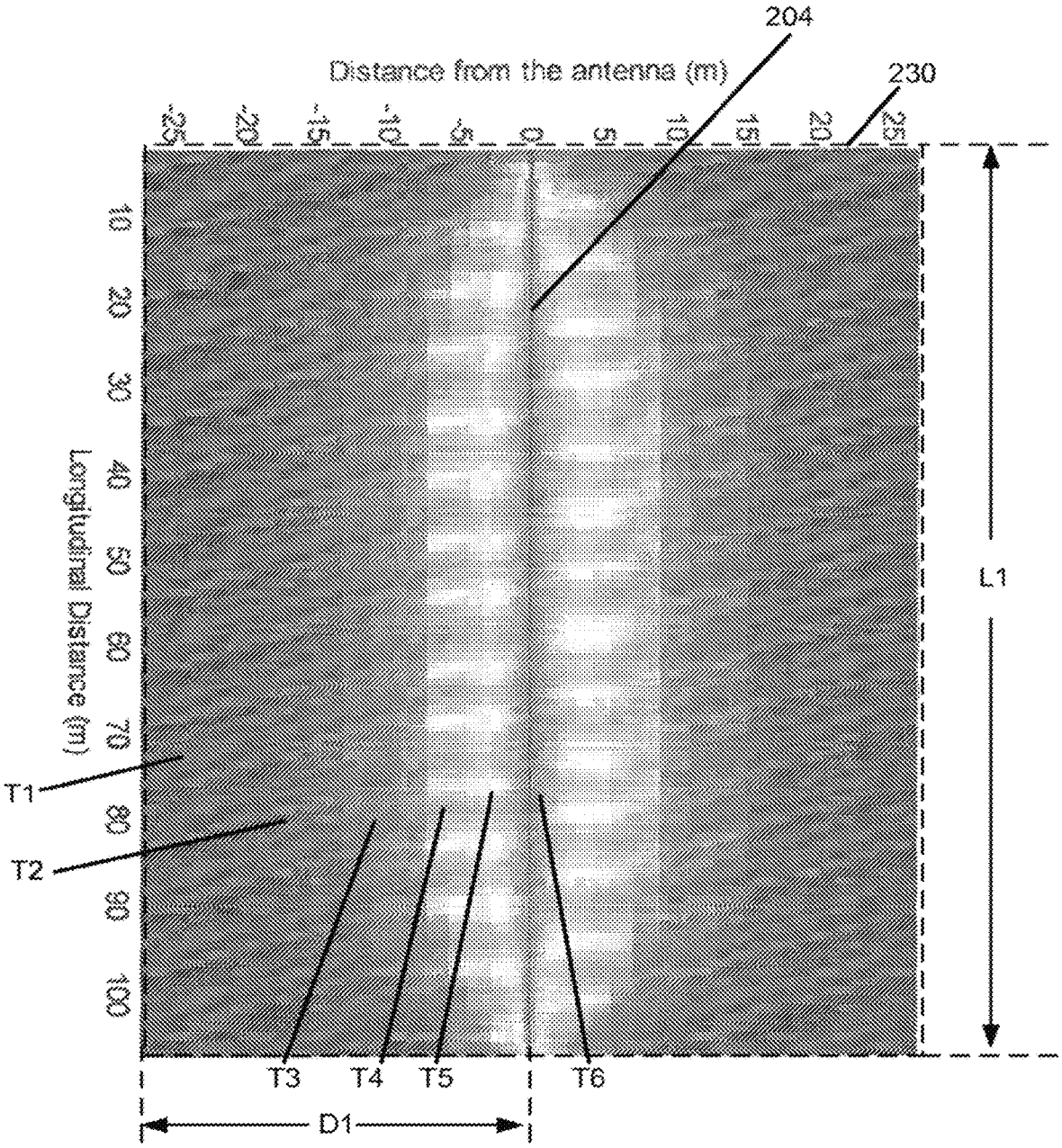
FIG. 5 is a diagram depicting a calculated temperature distribution after heating with the dual stepped shaped antenna shown in FIG. 4.

FIG. 5 is a diagram depicting the temperature distribution of the first portion 130 of a homogeneous oil-bearing formation 106 after radio frequency heating using the antenna 251 shown in FIG. 4.

The diagram illustrates an improved temperature distribution that can be achieved using the antenna 251 shown in FIG. 4. More specifically, the temperature distribution is much more uniform along the length of the antenna than in the example shown in FIG. 3.

In the example shown in FIG. 3, the oil-bearing formation 106 is assumed to be homogeneous with a dielectric constant of 85.3 and a loss tangent of 2.37.

Figure 6:
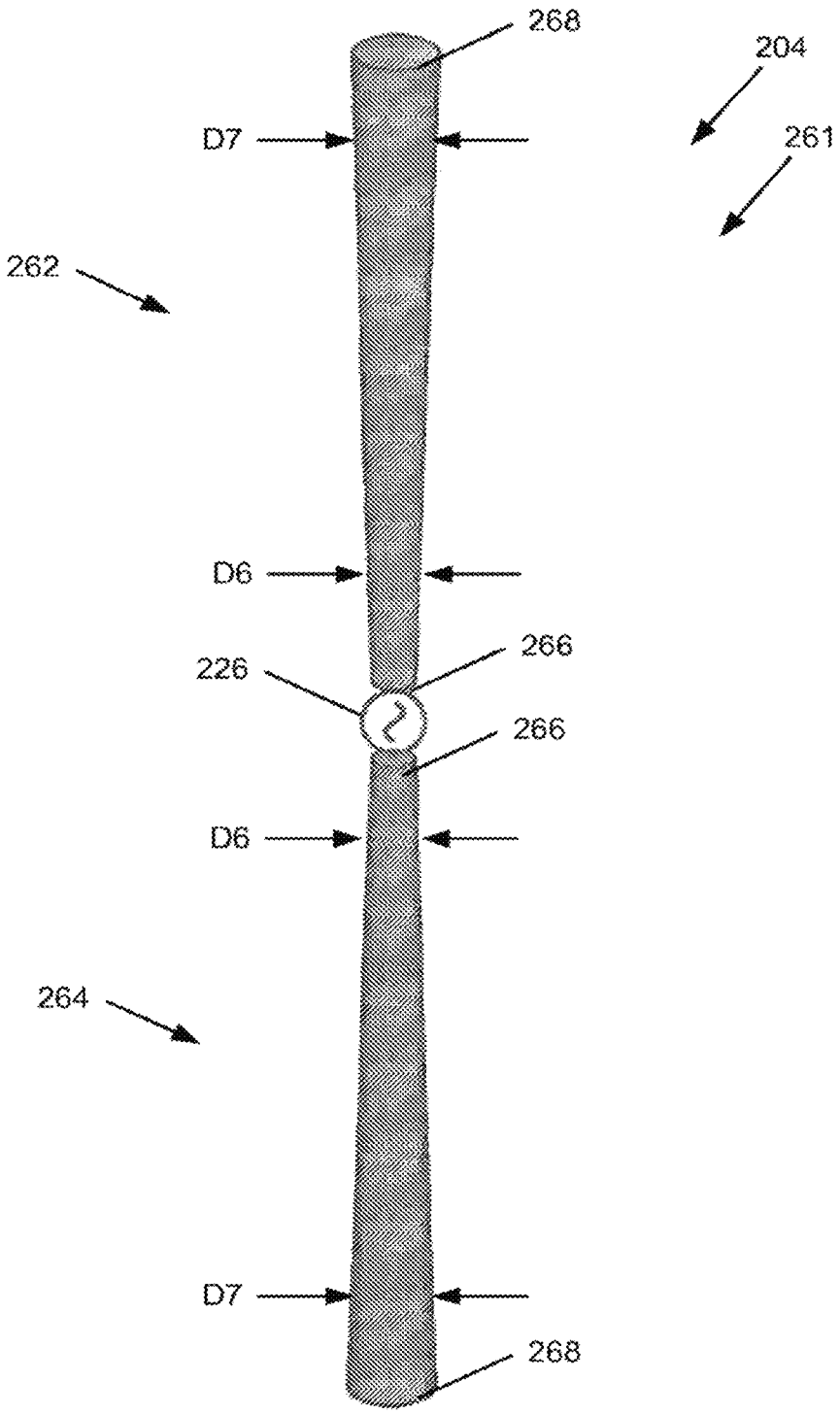
FIG. 6 is a schematic perspective view of another example subsurface antenna, namely a dual conical shaped antenna.

FIG. 6 is a schematic perspective view of another example of antenna 204. In this example, the antenna 204 includes elements 262 and 264 and an input terminal 226. The example shown in FIG. 6 is an example of a shaped antenna, and more specifically a dual conical shaped antenna 261. The antenna 261 is a dipole antenna similar to the antennas shown in FIGS. 2 and 4, but having frustoconical shaped elements 262 and 264.

In this example, the elements 262 and 264 have a diameter that gradually increases from the proximal ends 266 to the distal ends 268. For example, a cross-sectional distance D7 further from the input terminal 226 is greater than a cross-sectional distance D6 closer to the input terminal 226. In some embodiments the elements 262 and 264 are frustoconical.

A temperature distribution generated by radio frequency heating with the antenna shown in FIG. 6 is the same or similar to that shown in FIG. 5.

In some embodiments, the cross-sectional shapes of the elements (242, 244, 262, 264) are not circular, such as having an oval shape in which a cross-sectional distance in one direction is greater than a cross-sectional distance in another direction. The non-circular shape can be used, for example, to focus additional energy in one of the directions. For example, an oval frustoconical shaped antenna placed in a horizontal well in a thin oil bearing sands could be orientated so that more RF energy would be emitted in the direction of the thin oil bearing sand and less energy would be directed into heating the over- and under burden. Thin oil bearing sands are typically less than 30 ft. thick. In order to prevent undesirable rotation of the oval shaped antenna, alignment spacers can be attached to the inside of the casing prior to insertion of the oval shaped antenna into the well.

Figure 7:
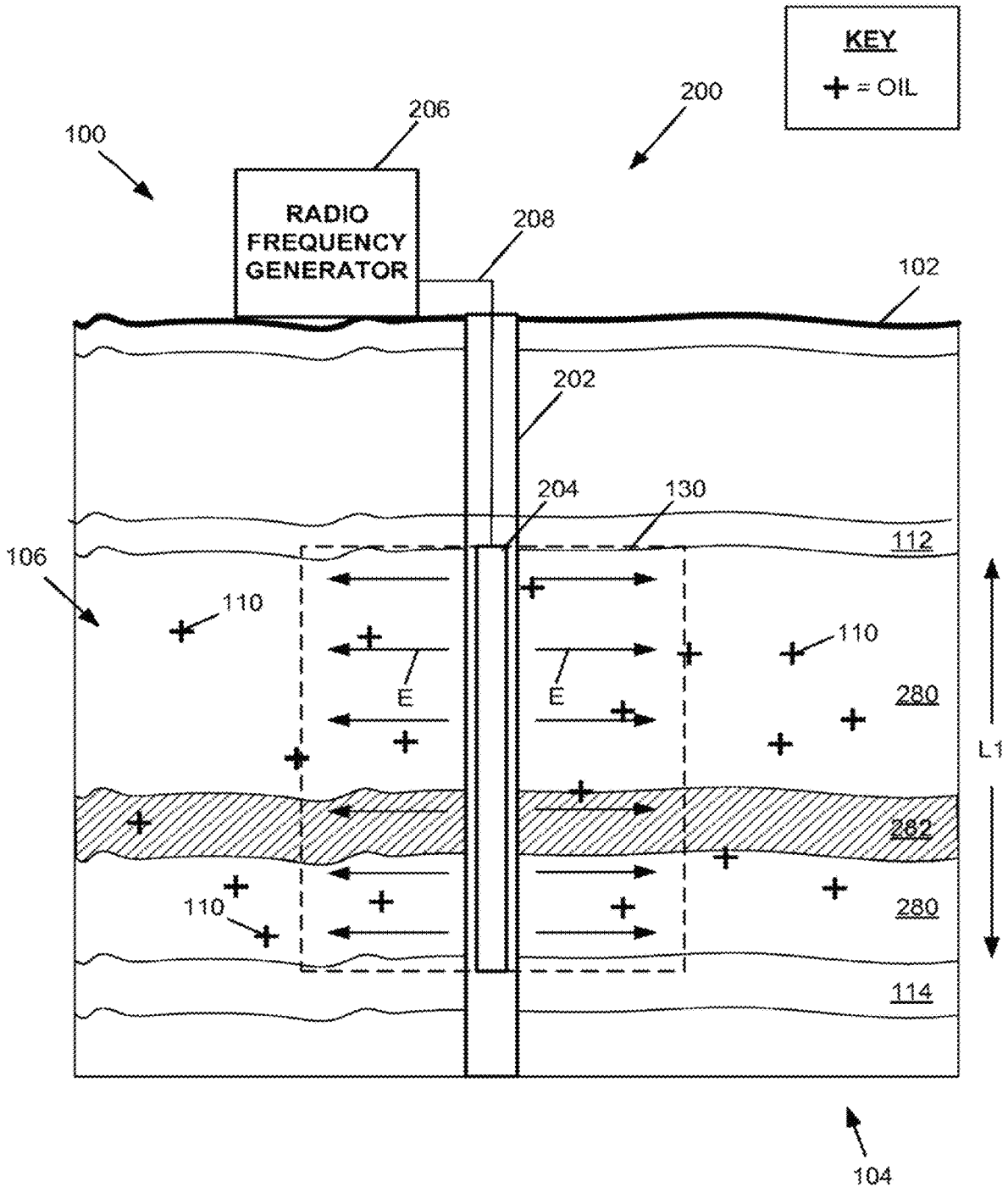
FIG. 7 is a schematic cross-sectional view of another portion of the Earth including a heterogeneous oil-bearing formation.

FIG. 7 is a schematic cross-sectional view of another example portion 100 of the Earth, and also illustrating at least a part of the example oil extraction system 200. Similar to the example shown in FIG. 1, the portion 100 includes the surface 102, plurality of underground layers 104, and an oil-bearing formation 106. The oil-bearing formation 106 includes oil 110. The part of the oil extraction system 200 includes the wellbore 202, the antenna 204, the radio frequency generator 206, and the transmission line 208. The first portion 130 of the oil bearing formation is also shown.

In this example, the oil-bearing formation 106 is heterogeneous, and includes regions having different characteristics. For example, regions 280 have a first characteristic, and a region 282 has a second characteristic different from the first characteristic. In some embodiments, the characteristic is an electrical property of the region. An example of an electrical property is a dielectric property, such as the dielectric constant, loss tangent, and/or conductivity.

In some embodiments, characteristics of the oil-bearing formation are determined. One technique for determining such characteristics is by drilling and collecting core samples and then measuring the dielectric constant and loss tangent (or conductivity) of thin slices of core samples as well as other geophysical properties.

Another technique for determining characteristics of the oil-bearing formation 106 is by drilling one or more additional wells a distance away from the wellbore 202. A detector can then be placed into the second wellbore at various depths to detect the electromagnetic signals generated by the antenna 204 in the wellbore 202. The strength of the signal at different depths can be used to identify one or more characteristics of the oil-bearing formation 106, for example.

Once the characteristics of at least a portion 130 of the formation 106 have been determined, the portion 130 is then classified into at least two regions, where each region has similar characteristics. In the example shown in FIG. 7, the portion 130 is classified into regions 280 and 282, where region 282 exhibits greater loss than region 280. Variations in RF loss of formations can be due to variations in brine and clay content and can lead to a significant increase in dielectric constant and/or loss tangent.

Figure 8:
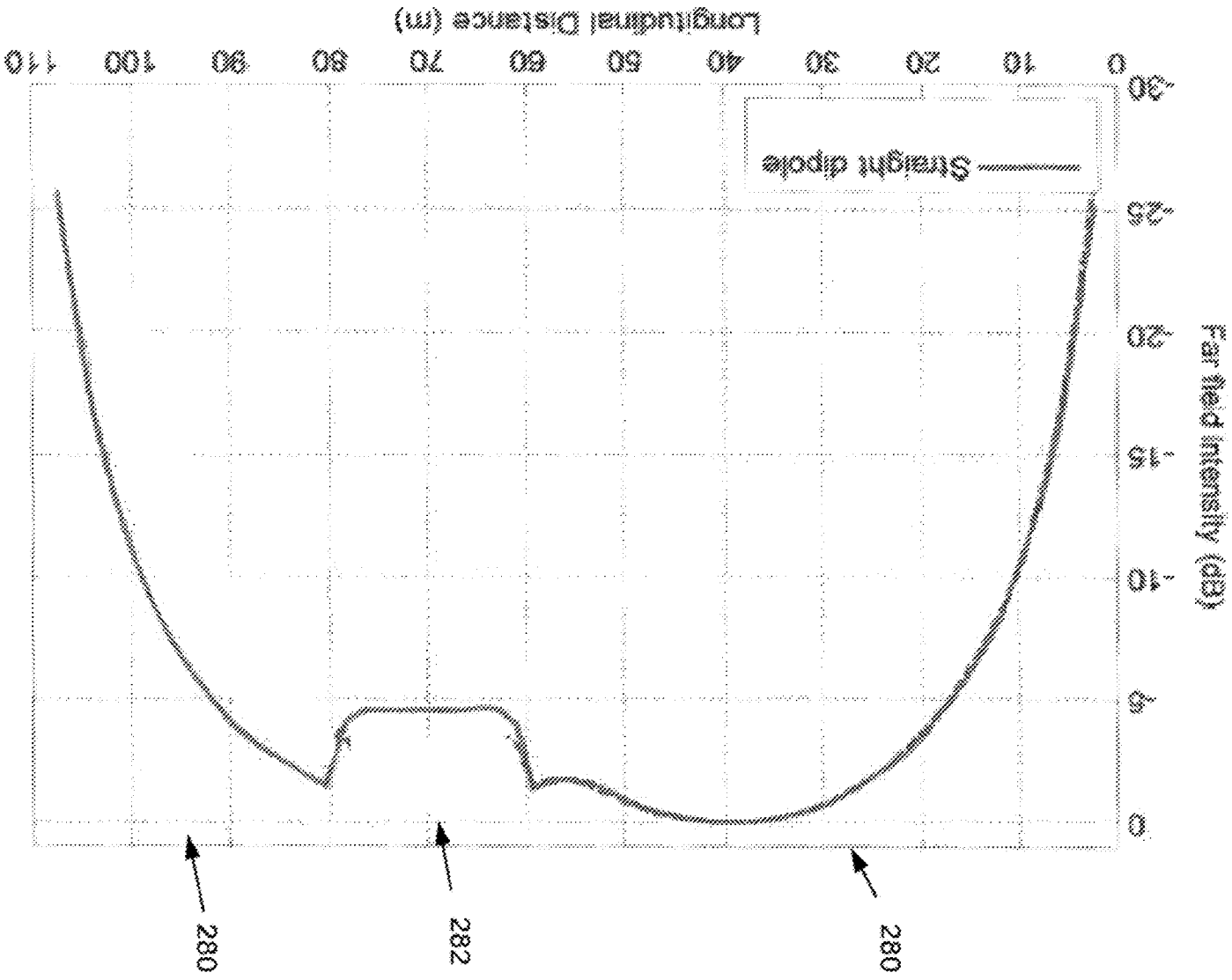
FIG. 8 is a diagram illustrating a field response of the non-shaped antenna shown in FIG. 2.

FIG. 8 is a diagram illustrating the field response of the dipole antenna 204 shown in FIG. 2, when used in the example heterogeneous formation shown in FIG. 8. The heterogeneous formation includes regions 280 and 282.

Due to the presence of the highly lossy region 282, the electromagnetic field within this region (e.g., at longitudinal distance 70 m, in this example) within region 282 is significantly attenuated away from the antenna as compared with the field response in the less lossy region 280 (e.g., at longitudinal distance 40 m). This response can be improved by using an antenna, such as illustrated in FIG. 9.

Figure 9:
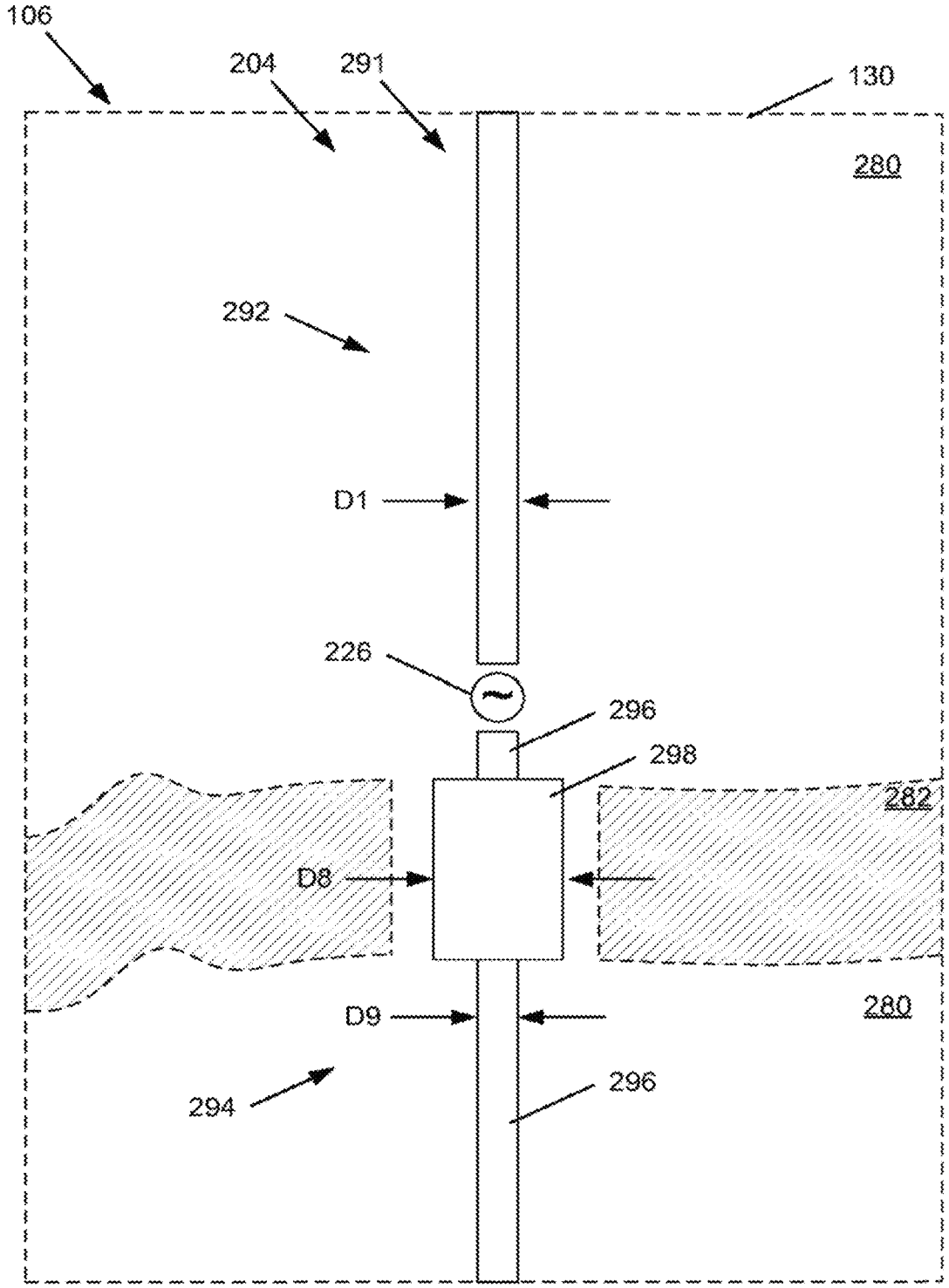
FIG. 9 is a schematic cross-sectional view of another example subsurface antenna, namely a formation-specific shaped antenna.

FIG. 9 is a schematic cross-sectional view of another example of an antenna 204, which is specially designed based on the unique characteristics of the heterogeneous formation shown in FIG. 7. The example shown in FIG. 9 is an example of a shaped antenna, and more specifically a formation-specific shaped antenna 291. The antenna 291 is a shaped dipole antenna including elements 292 and 294, and input terminal 226. A portion 130 of the heterogeneous oil-bearing formation 106 is also shown, including regions 280 and 282, as previously illustrated and described with reference to FIG. 7. For ease of illustration, certain portions of the oil-extraction system 200 are not shown, such as the wellbore and casing.

In this example, the configuration of the antenna 291 is designed based on the characteristics of the portion 130 of the oil-bearing formation 106. Because the element 292 is designed to be inserted entirely into the substantially homogeneous region 280 having substantially the same characteristic, the element 292 is a dipole antenna element with a constant diameter D1 (such as shown in FIG. 2) or, alternatively, with a gradually increasing or stepped diameter, as in FIGS. 4 and 6.

The element 294, however, is designed to be inserted into the heterogeneous regions including the regions 280 and 282, which have different characteristics. Therefore, the shape of the element 294 is varied in each region. In this example, the antenna includes multiple regions 296 and 298. Positions of the regions 296 and 298 are selected to align with the positions of regions 280 and 282, when the antenna 291 is installed within portion 130 of the oil-bearing formation 106.

In some embodiments, the cross-sectional distance D8 of region 298 is greater than the cross-sectional distance D9 of the region 296. When the size of the region 298 is increased, additional energy can be directed into the corresponding region 282 of the oil-bearing formation 106, as shown in FIG. 10.

Figure 10:
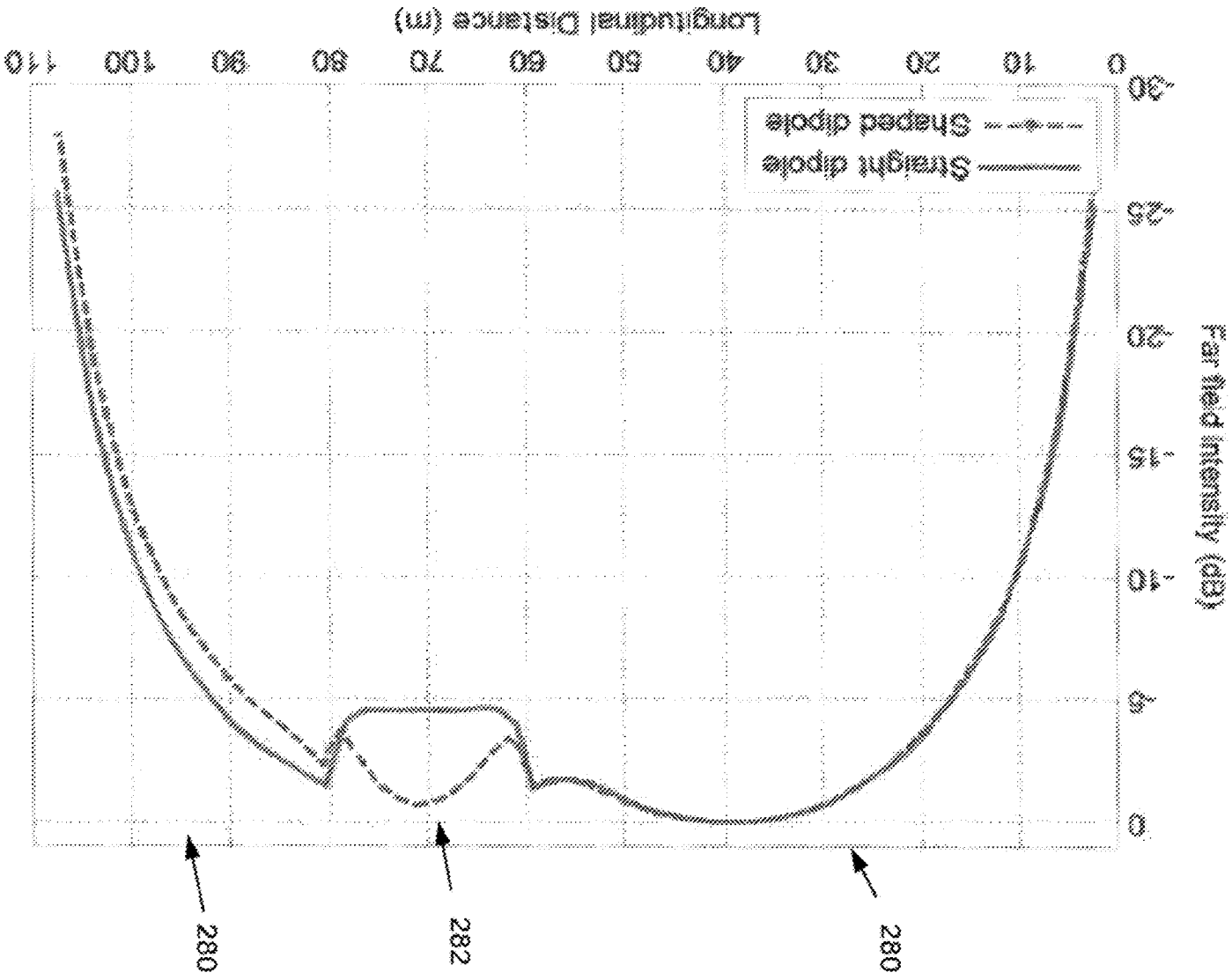
FIG. 10 is a diagram illustrating the improved field response of the formation-specific shaped antenna shown in FIG. 9.

FIG. 10 is a diagram illustrating the improved field response of the formation-specific shaped antenna 291 shown in FIG. 9, when used in the example heterogeneous formation 106, shown in FIGS. 7 and 9. The heterogeneous formation includes regions 280 and 282.

By shaping the antenna, such as by increasing the size of a part of the antenna 204 located within the highly lossy region 282, the field response in this region 282 is improved.

In some embodiments, multiple adjustments are made to the antenna diameter to compensate for multiple high absorption regions that may occur in typical heterogeneous oil bearing formations. In other possible embodiments, an oil-bearing formation 106 is gradually heated over time using a series of vertical wells. The antenna 204 is used to heat one well for a period of 1 to 12 months before being moved to another location. However, due to the shifting position of the high loss zone across the oil bearing formation, in some embodiments the antenna is constructed from smaller sections that are fastened (e.g., screwed) together. As the antenna 204 is moved from vertical well to vertical well, the formation is first electromagnetically logged to determine the location of the high loss zone(s) of region 282. The antenna 204 is then assembled or reassembled to position the region 298 along the length of the antenna 204 to match the location of the high loss zone of region 282 so that the oil bearing formation can be heated in a uniform manner. In some embodiments, the antenna 204 is assembled from a number of prefabricated sections, and the selection and order of the sections is selected to match the desired heating properties and coordinated to the properties of the oil-bearing formation 106.

In another possible embodiment, the shape of the antenna 204 may need to change as the oil field undergoes production. As oil is withdrawn from the field, the reservoir will become more transparent to the passage of RF as the formation fluids, which include brine are withdrawn. Thus after 1 to 12 months of heating or longer, the antenna can be pulled from the well, reconfigured to better match the changing electrical characteristics of the field, and reinserted back into the well with the modified configuration. In some embodiments, when in a vertical or near vertical orientation, it would be more desirable to decrease the diameter of the top half of the antenna. In another embodiment, when in a horizontal well, a circular shaped antenna may be replaced with one that is oval.

Additional embodiments are illustrated and described with reference to FIGS. 11-17, which describe additional modifications that can be made to the antennas 204 described herein to form additional embodiments of the antenna 204 according to the present disclosure.

Figure 11:
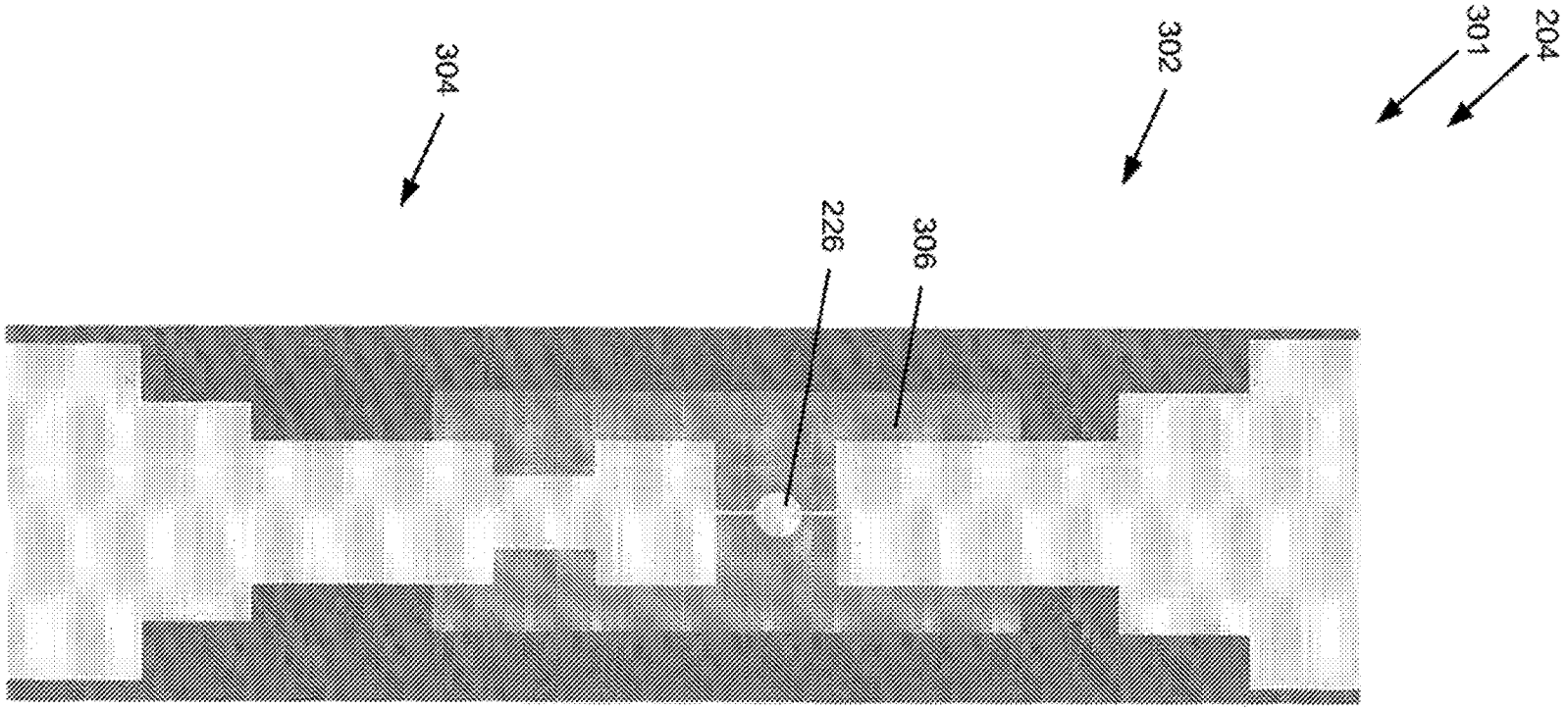
FIG. 11 is a schematic cross-sectional view of another example antenna, namely an asymmetric dual stepped shaped antenna.

FIG. 11 is a schematic cross-sectional view of another example antenna 204 including elements 302 and 304 and input terminal 226. In this example, the antenna 204 has an asymmetric configuration, having differently shaped elements 302 and 304, with stepped regions of increasing diameter. The antenna shown in FIG. 11 is an example of a shaped antenna, and more specifically an asymmetric dual stepped shaped antenna 301 with dielectric loading.

Asymmetric configuration of the antenna can be used to simultaneously shape the field and provide an impedance match. In some embodiments, this is done in parallel with reactive loading as explained in further detail herein.

Additionally, this example illustrates the encapsulation of a section of the antenna 301 in a dielectric material 306 to selectively load the section of the antenna 204. In another possible embodiment, the entire antenna 301 is encapsulated in a dielectric material 306. Examples of the dielectric material 306 include Alumina, Teflon, glass-fiber filled Teflon, PEEK, glass-fiber filled PEEK, PPS, glass-fiber filled PPS, fiberglass, hydrocarbon solvents such as gasoline, diesel, toluene, lubricating oil base stock, bright stock, and combinations thereof. In some embodiments, the dielectric material has a low loss and high voltage breakdown.

The dielectric material 306 can modify the near field pattern by concentrating the electric field of certain polarizations and changing the effective electric length of elements of the antenna as well as changing the balance between electric fields with different polarizations which can be advantageous, such as to reduce the near field strength immediately adjacent the antenna. In some embodiments, the dielectric material 306 is placed in the vicinity of the excitation of the antenna (such as the input terminal 226). The dielectric may also beneficially affect the impedance and radiation characteristic as well as improve the mechanical integrity of the antenna 204, in some embodiments. High voltage tolerance is also improved in some embodiments.

In some embodiments, a liquid dielectric material 306 is used as a cooling agent.

Figure 12:
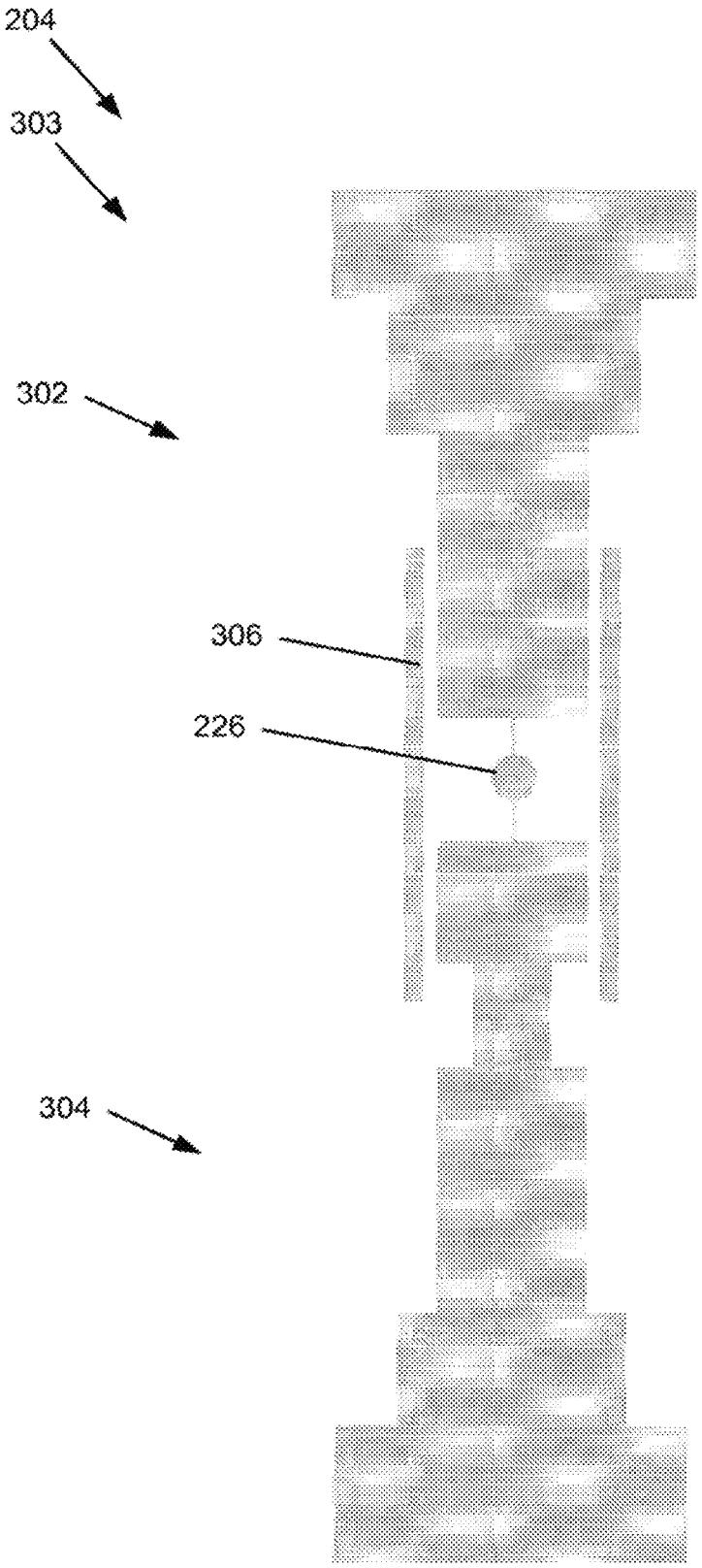
FIG. 12 is a schematic cross-sectional view of another example antenna, namely an asymmetric dual stepped shaped antenna.

FIG. 12 is a schematic cross-sectional view of another example antenna 204 including elements 302 and 304 and input terminal 226. In this example, the antenna includes a metal sleeve 310. The antenna shown in FIG. 12 is an example of a shaped antenna, and more specifically an asymmetric dual stepped shaped antenna 303 with metal sleeve.

In this example, the antenna 303 is loaded by a metal sleeve 310. In some embodiment, the metal sleeve 310 is positioned around the feed point (such as input terminal 226), which can simultaneously affect the radiation pattern and act as an impedance transformer for the antenna 303. In some embodiments the metal sleeve 310 acts as a sleeve antenna.

Figure 13:
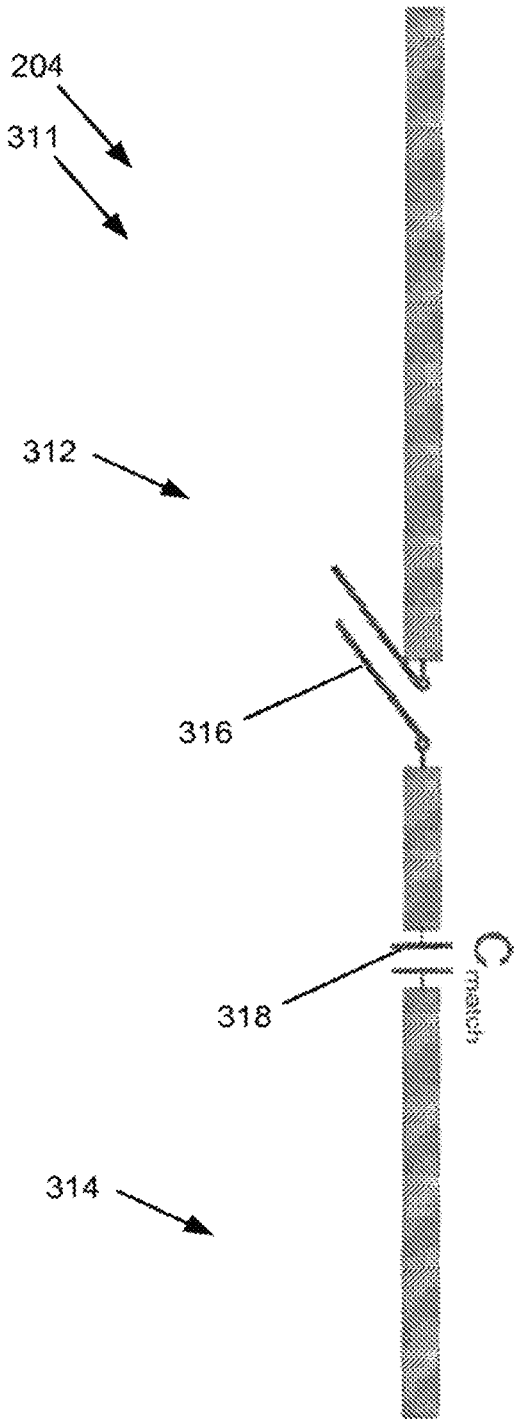
FIG. 13 is a schematic cross-sectional view of another example antenna, namely a dipole antenna with a single matching capacitance.

FIG. 13 is a schematic cross-sectional view of another example antenna 204 including elements 312 and 314, input terminals 316, and matching capacitance 318. The example shown in FIG. 13 is an example of a dipole antenna 311 with a single matching capacitance. The dipole antenna 311 can be a shaped or non-shaped.

A matching network can be designed in different ways to achieve the desired matching effect. In one embodiment, the antenna 311 design includes a reduction in the antenna's reactance to zero, or close to zero, at the desired frequency of operation. This can be done, for example, by adding a capacitance or inductance of appropriate size in series between the sections of the antenna elements 312 and 314. The elements 312 and 314 can be multi-sectional, for example.

In some embodiments, the matching capacitance 318, or matching inductance, is added immediately next to the input terminals 316, or alternatively, spaced a certain distance from them. Combinations of various reactive components are used in other embodiments. The capacitance or inductance can be lumped or distributed.

Dipole elements 312 and 314 can be straight or configured with any of the other element shapes described herein.

In some embodiments, the antenna 311 is fed by a coaxial line, but other embodiments can utilize other transmission lines.

The value of the matching capacitance 318, or inductance, depends on the frequency of operation and the antenna 311 reactance. The input impedance of the antenna can be denoted as Zin=R+jX at the operational frequency ($f_{op}$), where X is the antenna's reactance. If the reactance is positive, the optimal value of the matching capacitance 318 is given by $Cmatch=1/(2*\pi*f_{op}*X)$. If the reactance is negative, the optimal value of the matching inductance is given by $Lmatch=|X|/(2*\pi*f_{op})$, where |X| denotes the absolute value of the antenna's reactance.

In some embodiments the optimal values are used. In other embodiments, other values of the capacitance or inductance are used.

As one example, the antenna 311 is supplied with an RF signal having a frequency of 0.55 MHz. At this frequency, the antenna's input impedance is Zin=88.6+j*176.2 Ohms. Therefore, the value of the matching capacitance is Cmatch=1.64 nF.

By adding a matching capacitance or inductance in series with the antenna terminals, the antenna's reactance is reduced to a very small value, which is close to or equal to zero. Therefore, the input impedance of the dipole antenna 311 with its matching capacitance 318, or inductance, is considered to be real and can be matched to the characteristic impedance of the feeding transmission line by using a quarter wave transformer.

Figure 14:
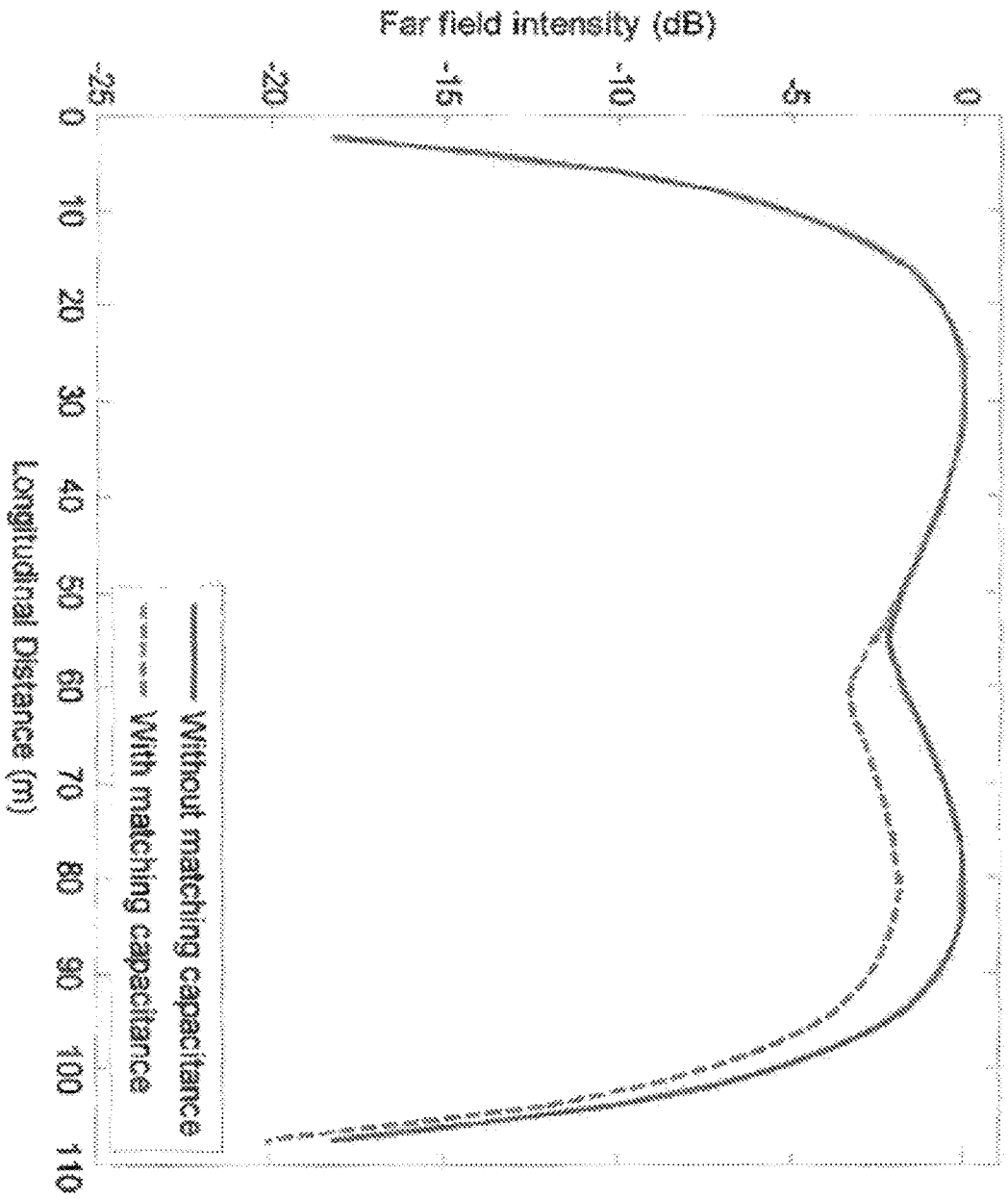
FIG. 14 is a diagram illustrating a field disturbance caused by the single matching capacitance of the antenna shown in FIG. 13.

However, adding a single matching capacitance 318, or inductance, to the input terminals 316 disturbs the radiated field by lowering or increasing its intensity at the side where the capacitance 318, or inductance, is added, as shown in FIG. 14. A disturbed field can be advantageous when the oil-bearing formation is heterogeneous, as discussed in further detail herein.

In another possible embodiment, an antenna 204 includes multiple different reactive components arranged at multiple locations of the antenna 204.

FIG. 14 is a diagram illustrating the field disturbance caused by a single matching capacitance 318 added to an antenna 311, as shown in FIG. 13. In this example, the field response of a dipole antenna (such as shown in FIG. 2) is shown, as well as the disturbed field caused by the addition of the single matching capacitance 318.

Figure 20:
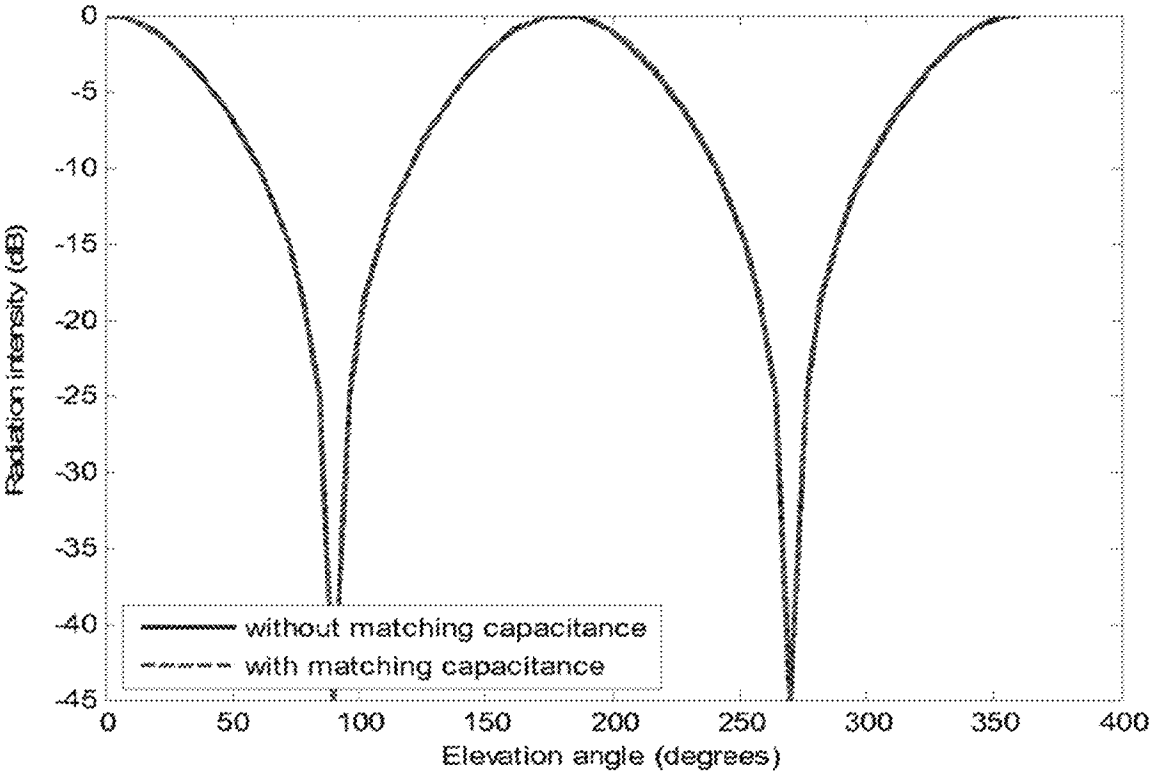
FIG. 20 is graph illustrating an emission pattern of a dipole antenna in free space.

The techniques discussed above have significant differences to techniques used with antennas designed to radiate into a low loss "free space" environment with the objective to achieve a desired radiation "far-field pattern" many wavelengths away from the antenna. This far-field pattern is not affected by the addition of a single matching capacitance between the sections of antenna arms, for example. As an illustration, the elevation-plane, far field patterns of a 100-m long, center-fed, straight dipole with and without the matching capacitance are compared in FIG. 20, herein. The outer diameter of the dipole is 5 inches and the frequency of operation is 2 MHz. The matching capacitor with a capacitance of 135.8 pF is added 5 m from its input terminals. The two patterns are identical, showing that the matching reactive component does not affect the operation of the communication antennas. FIGS. 14 and 20 illustrate a difference between dipole antennas operating in a lossy formation (such as the oil-bearing formation 106) and free space.

Figure 15:
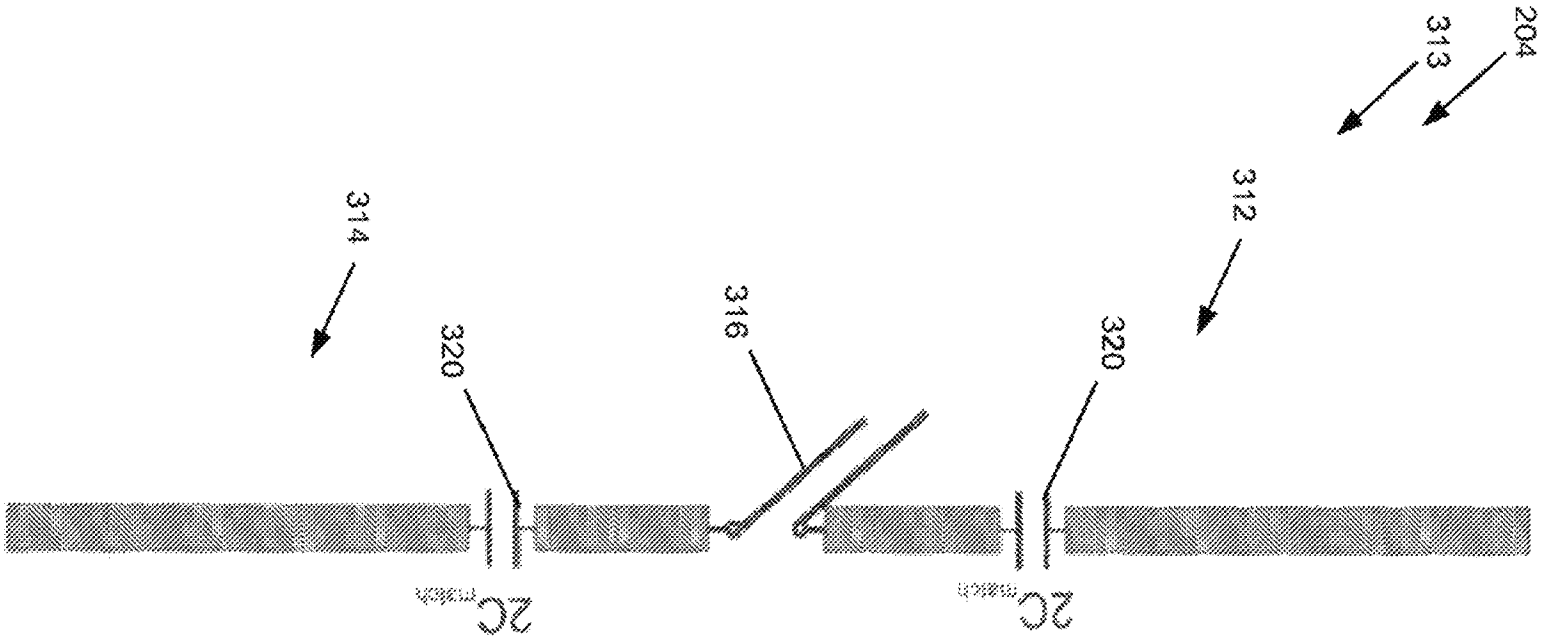
FIG. 15 is a schematic cross-sectional view of another example antenna, namely a dipole antenna with dual matching capacitances.

FIG. 15 is a schematic cross-sectional view of another example antenna 204. In this example, the antenna 204 includes elements 312 and 314 and input terminals 316, and further including two matching capacitances 320. The example shown in FIG. 15 is an example of a dipole antenna 313 with dual matching capacitances. The dipole antenna 313 can be a shaped antenna or non-shaped.

In some embodiments, the distributed field shown in FIG. 14, generated by the antenna 313 shown in FIG. 13, is undesirable. The example shown in FIG. 15 avoids the disturbance by adding two matching capacitors 320, or inductors, symmetrically to the elements 312 and 314 around the input terminals 316.

The values of the matching capacitors 320 can be selected as 2*Cmatch, using the formula for Cmatch provided above. If inductors are used, the values of the inductors can be selected as Lmatch/2, using the formula for Lmatch provided above. Other values are used in other embodiments.

Figure 16:
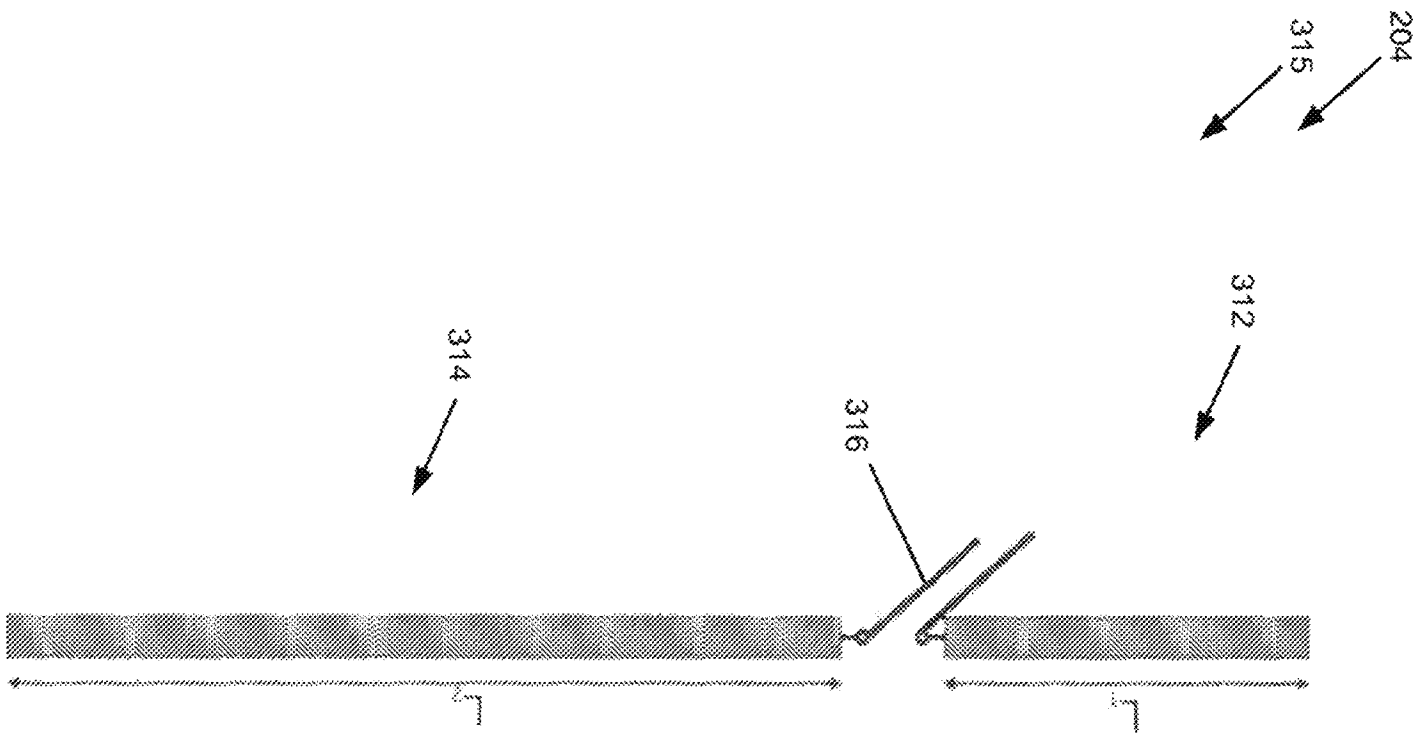
FIG. 16 is a schematic cross-sectional view of another example antenna, namely an asymmetrically fed dipole antenna.

FIG. 16 is a schematic cross-sectional view of another example antenna 204 including elements 312 and 314 and input terminals 316. The example shown in FIG. 16 is an example of a dipole antenna, and more specifically of an asymmetrically fed dipole antenna 315. The antenna 315 can be a shaped or non-shaped.

The asymmetrically fed dipole antenna 315 is asymmetrical because the lengths of the element 312 (L1) and the element 314 (L2) are not equal. For example, length L1 can be longer or shorter than length L2. Typically, the difference in length between the two elements 312 and 314 is in a range from 10% to 50% of $3\lambda/8$. The asymmetrical lengths result in a modified radiation pattern. This radiation pattern can be useful when a heterogeneous formation requires additional energy be radiated into one region of the formation than to another region of the formation, for example.

In another possible embodiment, the asymmetric feed and the degree of asymmetry can be used to transform the impedance of the antenna 315 to a more convenient value.

Figure 17:
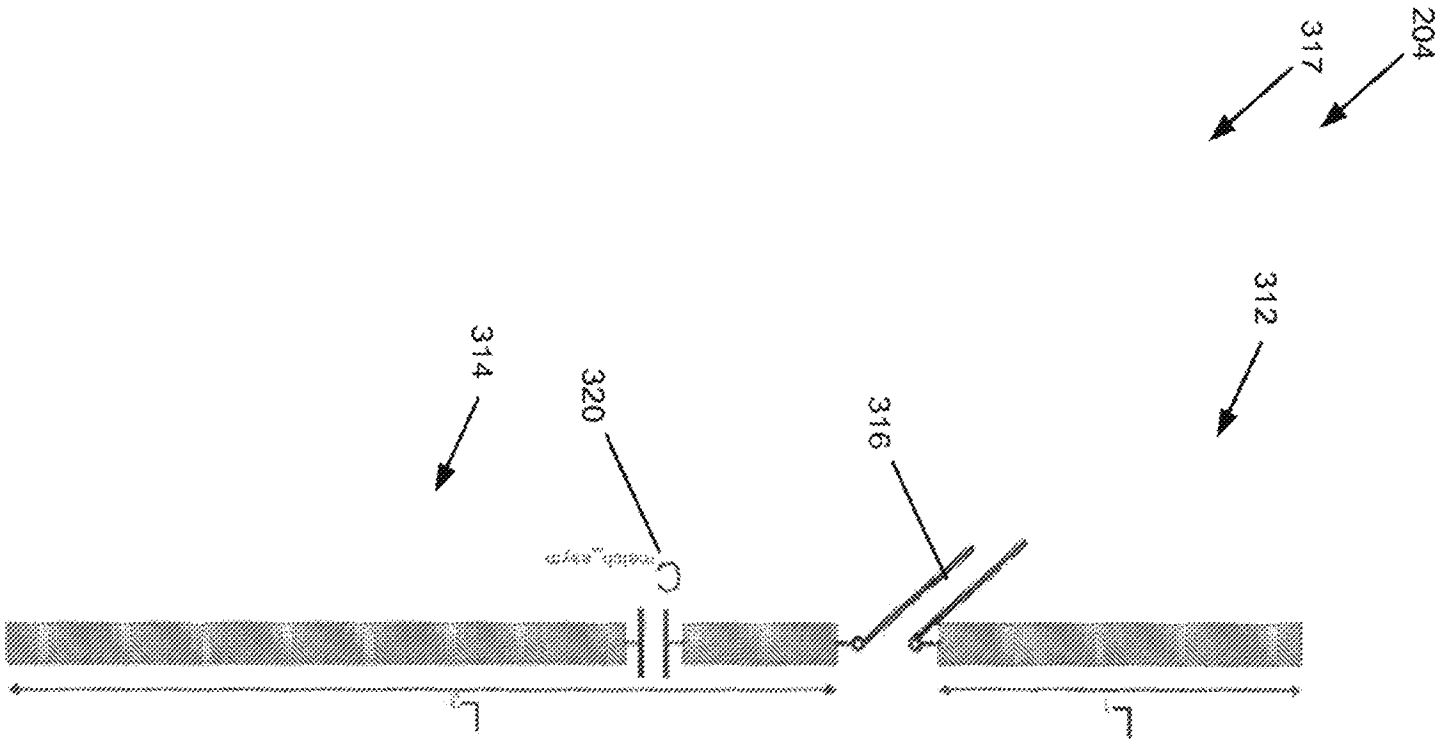
FIG. 17 is a schematic cross-sectional view of another example antenna, namely an asymmetrically fed dipole antenna with single matching capacitance.

FIG. 17 is a schematic cross-sectional view of another example antenna 204. The antenna shown in FIG. 17 is an example of a dipole antenna, and more specifically of an asymmetrically fed dipole antenna 317 with a single matching capacitance. In this example, the antenna 317 includes elements 312 and 314, input terminals 316, and matching capacitance 330. Antenna 317 can be shaped or non-shaped.

In some situations, adding two matching capacitors or inductors to a symmetrically fed antenna, as shown in FIG. 15, may be impractical for antennas operating inside a well, due to space restrictions or mechanical stability. In this case, we have discovered that an asymmetrically fed dipole antenna, such as shown in FIGS. 16 and 17, with a single matching capacitance or inductance (FIG. 17) can be used to achieve uniform, or more uniform, radiation.

Figure 18:
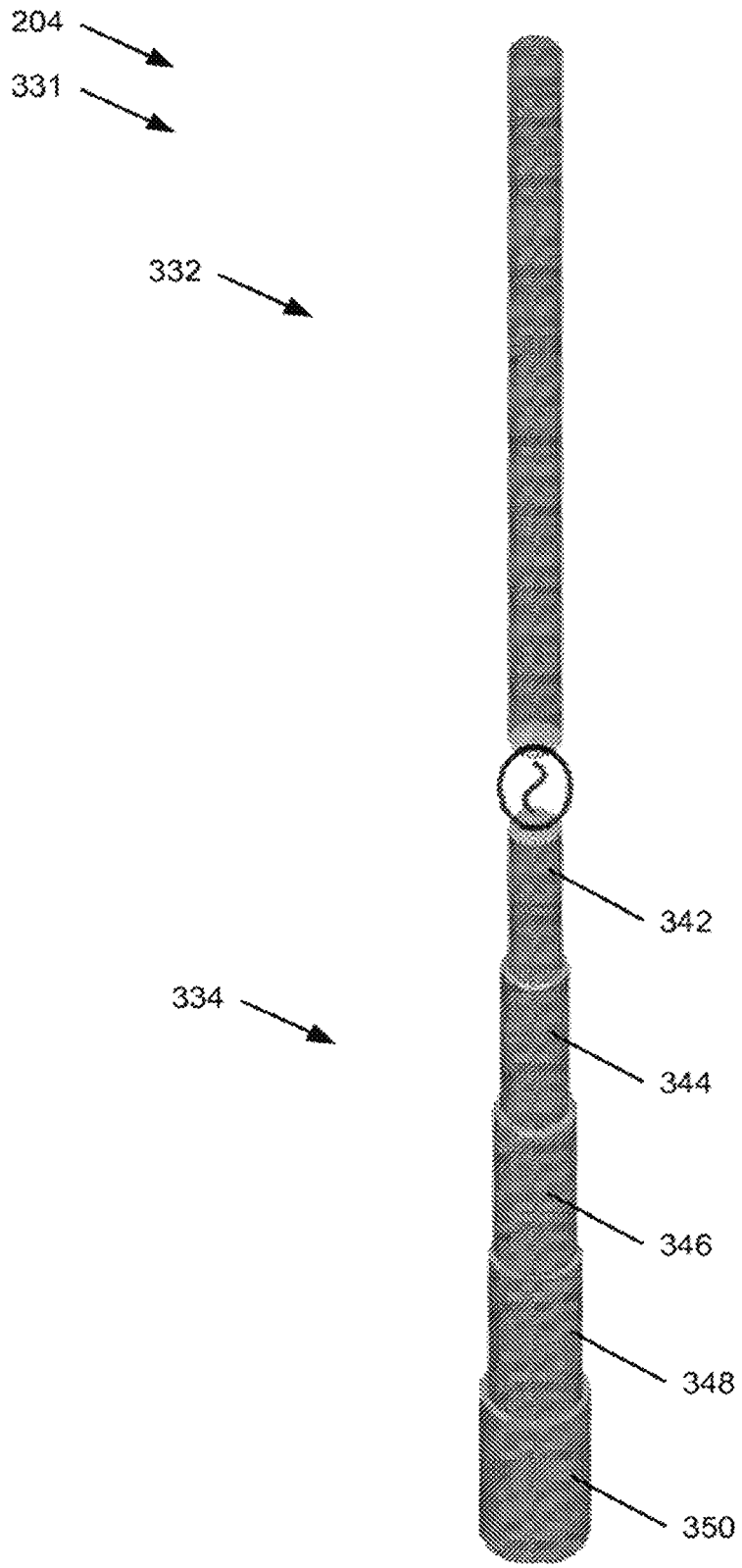
FIG. 18 is a schematic cross-sectional view of another example antenna, namely a single stepped shaped antenna.

FIG. 18 is a schematic cross-sectional view of another example antenna 204, namely a single stepped shaped antenna 331.

In some situations, it may be desirable to radiate more energy per unit length near one end (e.g., the bottom) of a vertical or highly slanted antenna than at the other end (e.g., the top). For example, because RF heating can produce steam, and as a result of convection and conduction, the heat from the bottom part of the antenna can rise and heat the upper portions of the reservoir. The example antenna 331, also referred to as a pear shaped antenna, can be inserted into a vertical or highly slanted well to produce more heating on the bottom part and less electromagnetic heating at the top to compensate for movement of heat due to convection and conduction.

As one example, the top element 332 has a length of 50 m with a constant diameter of 4 inches. The lower element 334 includes five regions 342, 344, 346, 348, and 350, having diameters of 4 inches, 5 inches, 6 inches, 7 inches, and 8 inches, respectively. The field radiated by the pear shaped antenna 331 is shown in FIG. 19.

Figure 19:
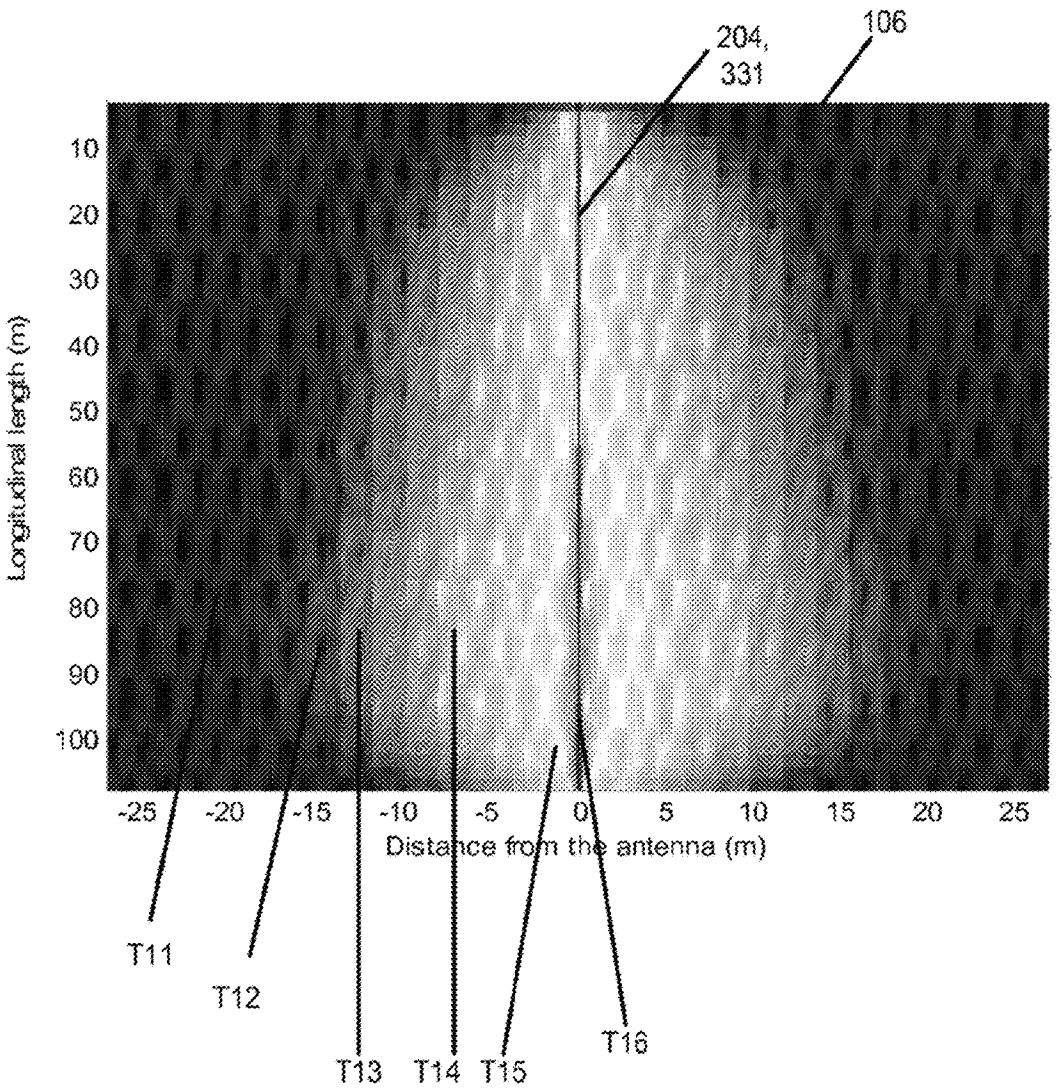
FIG. 19 is a diagram illustrating a calculated temperature distribution after heating with the single stepped shaped antenna shown in FIG. 18.

FIG. 19 is a diagram illustrating a calculated temperature distribution after heating with the single stepped/pear shaped antenna 331 shown in FIG. 18.

In this example, the oil-bearing formation has a temperature distribution as shown, which varies from the coolest temperature T11 to the warmest temperature T16 (with temperatures T12, T13, T14, and T15 therebetween).

In this example, the oil-bearing formation 106 is assumed to have the same electromagnetic properties as in previous examples, i.e. a dielectric constant of 85.3 and a loss tangent of 2.37.

FIG. 20 illustrates the elevation-plane, far field patterns of a 100-m long, center-fed, straight dipole in free space with and without a matching capacitance. The outer diameter of the example dipole is 5 inches and the frequency of operation is 2 MHz. The matching capacitor with a capacitance of 135.8 pF is added 5 m from its input terminals. The two patterns are identical, showing that the matching reactive component does not affect the operation of the communication antennas. FIGS. 14 and 20 illustrate a difference between dipole antennas operating in a lossy formation (such as the oil-bearing formation 106) and free space.

Other embodiments of an antenna 204 are also possible. For example, in some embodiments the subsurface antenna includes only one element (e.g., of the two elements of the various example antenna configurations illustrated and described herein), thereby forming a monopole subsurface antenna.

The various embodiments described above are provided by way of illustration only and should not be construed to limit the claims attached hereto. Those skilled in the art will readily recognize various modifications and changes that may be made without following the example embodiments and applications illustrated and described herein, and without departing from the true spirit and scope of the following claims.

What is claimed is:

1. A method of employing a subsurface antenna in an oil-bearing formation, the method comprising:

determining electrical characteristics of at least a portion of the oil-bearing formation;

classifying the portion of the oil-bearing formation into at least two regions including a first region of the oil-bearing formation and a second region of the oil-bearing formation based on the electrical characteristics, wherein the electrical characteristics are different in the first region of the oil-bearing formation than in the second region of the oil-bearing formation; and radiating electromagnetic waves from the subsurface antenna installed in a wellbore into the first region of the oil-bearing formation and the second region of the oil-bearing formation in an asymmetric radiation pattern, wherein the asymmetric radiation pattern radiates electromagnetic waves unequally to the first region of the oil-bearing formation and the second region of the oil-bearing formation to compensate for the different electrical characteristics in the first and second regions of the oil-bearing formation in a manner such that the oil-bearing formation can be heated in a uniform manner.

2. The method of claim 1, wherein the subsurface antenna has a first region and a second region, and wherein the first region of the subsurface antenna is aligned with the first region of the oil-bearing formation and the second region of the subsurface antenna is aligned with the second region of the oil-bearing formation.

3. The method of claim 2, wherein the second region of the subsurface antenna has a cross-sectional distance greater than a cross-sectional distance of the first region of the subsurface antenna.

4. The method of claim 1, further comprising:

removing the installed subsurface antenna from the wellbore, and configuring the subsurface antenna into a different configuration based on the electrical characteristics of the oil-bearing formation at a second location.

5. The method of claim 1, further comprising altering the subsurface antenna to compensate for changing electrical characteristics as oil is produced from the oil-bearing formation.

6. The method of claim 1, further comprising altering the subsurface antenna to compensate for changing electrical properties as one or more other fluids are injected into the oil-bearing formation.

7. The method of claim 1, wherein the subsurface antenna comprises:

a first radiating antenna element having a cross-sectional dimension between a proximal end of the first radiating antenna element and a distal end of the first radiating antenna element; and a second radiating antenna element having a cross-sectional dimension between a proximal end of the second radiating antenna element and a distal end of the second radiating antenna element;

wherein the cross-sectional dimension of the first radiating antenna element, the cross-sectional dimension of the second radiating antenna element, or both is non-uniform.

8. The method of claim 7, wherein the non-uniform cross-sectional dimension comprises an axially stepped shape, an axially multi-stepped shape, a frustoconical shape, a non-circular shape, a shape that increases along an axial length from a proximal end to a distal end, or any combination thereof.

9. The method of claim 1, wherein the subsurface antenna comprises:

a first radiating antenna element having a cross-sectional dimension between a proximal end of the first radiating antenna element and a distal end of the first radiating antenna element; and a second radiating antenna element having a cross-sectional dimension between a proximal end of the second radiating antenna element and a distal end of the second radiating antenna element;

wherein the proximal end of the second radiating antenna element is axially disposed away from the proximal end of the first radiating antenna element such that a gap is defined therebetween.

10. The method of claim 1, wherein the subsurface antenna comprises:

a first radiating antenna element having a cross-sectional dimension between a proximal end of the first radiating antenna element and a distal end of the first radiating antenna element; and a second radiating antenna element having a cross-sectional dimension between a proximal end of the second radiating antenna element and a distal end of the second radiating antenna element;

wherein the antenna assembly is axially asymmetric such that an axial length between the proximal end and the distal end of the first antenna radiating element is less than or greater than an axial length between the proximal end and the distal end of the second radiating antenna element.

* * * * *